US009976101B2

(12) United States Patent
Waynick

(10) Patent No.: US 9,976,101 B2
(45) Date of Patent: May 22, 2018

(54) METHOD OF MANUFACTURING CALCIUM SULFONATE GREASES USING DELAYED ADDITION OF NON-AQUEOUS CONVERTING AGENTS

(71) Applicant: NCH Corporation, Irving, TX (US)

(72) Inventor: J. Andrew Waynick, Lantana, TX (US)

(73) Assignee: NCH CORPORATION, Irving, TX (US)

( * ) Notice: Subject to any disclaimer, the term of this patent is extended or adjusted under 35 U.S.C. 154(b) by 0 days. days.

(21) Appl. No.: 14/990,473

(22) Filed: Jan. 7, 2016

(65) Prior Publication Data

US 2016/0115416 A1 Apr. 28, 2016

Related U.S. Application Data

(63) Continuation-in-part of application No. 13/664,574, filed on Oct. 31, 2012, now Pat. No. 9,273,265, which is a continuation-in-part of application No. 13/664,768, filed on Oct. 31, 2012, now Pat. No. 9,458,406.

(60) Provisional application No. 61/553,674, filed on Oct. 31, 2011.

(51) Int. Cl.

| | |
|---|---|
| ***C10M 141/10*** | (2006.01) |
| ***C10M 163/00*** | (2006.01) |
| ***C10M 159/24*** | (2006.01) |
| ***C10M 121/04*** | (2006.01) |
| ***C10M 177/00*** | (2006.01) |
| ***C10M 115/10*** | (2006.01) |

(52) U.S. Cl.

CPC ..... *C10M 121/04* (2013.01); *C10M 115/10* (2013.01); *C10M 177/00* (2013.01); *C10M 2201/02* (2013.01); *C10M 2201/062* (2013.01); *C10M 2201/08* (2013.01); *C10M 2201/084* (2013.01); *C10M 2201/085* (2013.01); *C10M 2201/087* (2013.01); *C10M 2203/1006* (2013.01); *C10M 2203/1065* (2013.01); *C10M 2205/024* (2013.01); *C10M 2205/028* (2013.01); *C10M 2205/0285* (2013.01); *C10M 2207/02* (2013.01); *C10M 2207/022* (2013.01); *C10M 2207/046* (2013.01); *C10M 2207/10* (2013.01); *C10M 2207/121* (2013.01); *C10M 2207/122* (2013.01); *C10M 2207/125* (2013.01); *C10M 2207/128* (2013.01); *C10M 2207/289* (2013.01); *C10M 2209/103* (2013.01); *C10M 2215/064* (2013.01); *C10M 2215/082* (2013.01); *C10M 2215/20* (2013.01); *C10M 2215/226* (2013.01); *C10M 2219/044* (2013.01); *C10M 2219/046* (2013.01); *C10M 2219/0466* (2013.01); *C10M 2223/043* (2013.01); *C10N 2210/02* (2013.01); *C10N 2220/022* (2013.01); *C10N 2220/032* (2013.01); *C10N 2220/082* (2013.01); *C10N 2230/06* (2013.01); *C10N 2230/12* (2013.01); *C10N 2230/38* (2013.01); *C10N 2230/52* (2013.01); *C10N 2240/04* (2013.01); *C10N 2240/50* (2013.01); *C10N 2250/10* (2013.01); *C10N 2270/00* (2013.01)

(58) Field of Classification Search

CPC .. C10M 113/04; C10M 113/10; C10M 115/10

USPC ..... 508/162, 336, 391, 161

See application file for complete search history.

(56) References Cited

U.S. PATENT DOCUMENTS

| | | | |
|---|---|---|---|
| 2,270,577 | A | 1/1942 | Bergstrom |
| 2,402,325 | A | 6/1946 | Griesinger |
| 2,418,894 | A | 4/1947 | McNab |
| 2,444,970 | A | 7/1948 | Zimmer |
| 2,485,861 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Van Ess |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Prem C Singh
*Assistant Examiner* — Francis C Campanell
(74) *Attorney, Agent, or Firm* — Ross Barnes LLP; Robin L. Barnes

(57) ABSTRACT

A method of manufacturing an overbased calcium sulfonate grease comprising a reduced amount of overbased calcium sulfonate, water and at least one non-aqueous converting agent, where at least a portion of the non-aqueous converting agent is added after one or more delay periods relative to the addition of the water. A delay period may involve the period of time it takes to adjust the temperature of the mixture, a period of time during which the mixture is held at a temperature or within a range of temperatures, and multiples and any combination thereof. These calcium sulfonate greases have improved thickener yield and high dropping points compared to greases of substantially similar composition made without a delay between the additions of water and a non-aqueous converting agent, particularly when a poor quality overbased calcium sulfonate is used.

68 Claims, No Drawings

(56) References Cited

U.S. PATENT DOCUMENTS

| | | | |
|---|---|---|---|
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,898,296 | A | 8/1959 | Pattenden et al. |
| 2,920,105 | A | 1/1960 | Kluge |
| 2,937,991 | A | 5/1960 | Carlyle |
| 2,940,930 | A | 6/1960 | Pattenden et al. |
| 2,956,018 | A | 10/1960 | Carlyle |
| 2,967,151 | A | 1/1961 | Morway |
| 2,977,301 | A | 3/1961 | Bergen |
| 2,978,410 | A | 4/1961 | Fullerton |
| 3,027,325 | A | 3/1962 | McMillen |
| 3,057,896 | A | 10/1962 | Schlight et al. |
| 3,150,088 | A | 9/1964 | Hunt et al. |
| 3,186,944 | A | 6/1965 | Dreher |
| 3,242,079 | A | 3/1966 | McMillen |
| 3,372,115 | A | 3/1968 | McMillen |
| 3,376,222 | A | 4/1968 | McMillen |
| 3,377,283 | A | 4/1968 | McMillen |
| 3,492,231 | A | 1/1970 | McMillen |
| 3,537,996 | A | 11/1970 | Holst |
| 3,655,558 | A | 4/1972 | Geyer et al. |
| 3,661,622 | A | 5/1972 | Rogers |
| 3,671,012 | A | 6/1972 | Scott |
| 3,679,584 | A | 7/1972 | Hellmuth |
| 3,681,242 | A | 8/1972 | Gilani et al. |
| 3,746,643 | A | 7/1973 | Rogers |
| 3,791,973 | A | 2/1974 | Gilani et al. |
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,297,227 | A | 10/1981 | Witte et al. |
| 4,376,060 | A | 3/1983 | Stadler |
| 4,435,299 | A | 3/1984 | Carley et al. |
| 4,444,669 | A | 4/1984 | Wittse, Jr. et al. |
| 4,483,775 | A | 11/1984 | Yamaguchi |
| 4,560,489 | A | 12/1985 | Muir |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,787,992 | A | 11/1988 | Waynick |
| 4,810,396 | A | 3/1989 | Jao et al. |
| 4,810,398 | A | 3/1989 | Van Kruchten et al. |
| 4,824,584 | A | 4/1989 | Muir |
| 4,830,767 | A | 5/1989 | Waynick |
| 4,902,435 | A | 2/1990 | Waynick |
| 4,904,399 | A | 2/1990 | Waynick |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz |
| 5,308,514 | A | 5/1994 | Olson |
| 5,338,467 | A * | 8/1994 | Olson ..... C10M 121/00 508/186 |
| 6,172,122 | B1 | 1/2001 | Lawate et al. |
| 6,239,083 | B1 | 5/2001 | Muir |
| 6,432,889 | B1 | 8/2002 | Kinoshita et al. |
| 6,596,672 | B1 | 7/2003 | Carrick et al. |
| 6,869,111 | B2 | 3/2005 | Goto et al. |
| 6,875,731 | B1 | 4/2005 | Bence |
| 7,241,723 | B2 | 7/2007 | Zhang |
| 7,294,608 | B2 | 11/2007 | Oldiges |
| 7,517,837 | B2 | 4/2009 | Kurosky et al. |
| 2003/0111838 | A1 | 6/2003 | Goto et al. |
| 2005/0054541 | A1 * | 3/2005 | Zhang ..... C10M 169/06 508/180 |
| 2005/0215442 | A1 | 9/2005 | Sivik et al. |
| 2006/0025317 | A1 * | 2/2006 | Olson ..... C10M 117/04 508/460 |
| 2006/0223719 | A1 | 10/2006 | Riff et al. |
| 2007/0060485 | A1 | 3/2007 | Waynick |
| 2009/0305920 | A1 | 12/2009 | Kato et al. |
| 2011/0021391 | A1 | 1/2011 | E et al. |
| 2011/0048809 | A1 | 3/2011 | Duckworth |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |
| 2013/0109602 | A1 | 5/2013 | Waynick |
| 2014/0121139 | A1 | 5/2014 | Waynick |

FOREIGN PATENT DOCUMENTS

| | | |
|---|---|---|
| CN | 102051257 | 5/2011 |
| CN | 102634400 | 8/2012 |
| CN | 103952215 | 7/2014 |
| CN | 104024162 | 9/2014 |
| GB | 816318 | 7/1959 |
| GB | 1239860 | 7/1971 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| WO | WO2011098616 | 8/2011 |

OTHER PUBLICATIONS

Boner, C.J. Manufacture and Application of Lubricating Greases, 1954, p. 369, Hafner Publishing Company, Inc.

* cited by examiner

METHOD OF MANUFACTURING CALCIUM SULFONATE GREASES USING DELAYED ADDITION OF NON-AQUEOUS CONVERTING AGENTS

CROSS-REFERENCE TO RELATED APPLICATION

This application is a continuation-in-part of U.S. application Ser. No. 13/664,574 filed on Oct. 31, 2012, which claims the benefit of U.S. provisional patent application No. 61/553,674 filed Oct. 31, 2011. This application is also a continuation-in-part of U.S. application Ser. No. 13/664,768 filed on Oct. 31, 2012, which claims the benefit of U.S. provisional patent application No. 61/553,674 filed on Oct. 31, 2011.

BACKGROUND OF THE INVENTION

1. Field of the Invention

This invention relates to overbased calcium sulfonate greases made with delayed addition of non-aqueous converting agents and the method for manufacturing such greases to provide improvements in both thickener yield and expected high temperature utility as demonstrated by dropping point, even when the oil-soluble overbased calcium sulfonate used to make the grease is considered to be of poor quality.

2. Description of Related Art

Overbased calcium sulfonate greases have been an established grease category for many years. One known process for making such greases is a two-step process involving the steps of "promotion" and "conversion."Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases. Typically the second step ("conversion") is to add a converting agent or agents, such as propylene glycol, iso-propyl alcohol, water, formic acid or acetic acid, to the product of the promotion step, along with a suitable base oil (such as mineral oil) if needed to keep the initial grease from being too hard, to convert the amorphous calcium carbonate to a very finely divided dispersion of crystalline calcium carbonate. When acetic acid or other acids are used as a converting agent, typically water and another non-aqueous converting agent (a third converting agent, such as an alcohol) are also used; alternatively only water (without the third converting agent) is added, but the conversion then typically occurs in a pressurized vessel. Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The crystalline form of the calcium carbonate is preferably calcite. This extremely finely divided calcium carbonate, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

Much of the known prior art using the two step method teaches the addition of all converting agents (water and non-aqueous converting agents) at the same time and usually prior to heating. However, a few prior art references disclose a time interval (although always poorly defined or not defined at all) between the addition of water and the addition of at least part of the non-aqueous converting agent(s). For example, U.S. Pat. No. 4,560,489 discloses a process (examples 1-3) where base oil and overbased calcium carbonate are heated to around 150° F., then water is added, the mixture is then heated to around 190° F. before adding acetic acid and methyl Cellosolve (a highly toxic monomethylether of ethylene glycol). The resulting grease contains greater than 38% overbased calcium sulfonate and the '489 patent points out that the ideal amount of overbased calcium sulfonate for the processes disclosed therein is around 41-45%, since according to the '489 patent using less than 38% results in a soft grease. The resulting grease of example 1 in the '489 patent has a dropping point of around only 570° F. The '489 patent does not state the duration of delay between the addition of water and the addition of the non-aqueous converting agents, but indicates that the addition was immediate after a period of heating from 150 F to just 190 F. The dropping point and thickener yield in the '489 patent are not desirable.

Additionally, U.S. Pat. Nos. 5,338,467 and 5,308,514 disclose the use of a fatty acid, such as 12-hydroxystearic acid, as a converting agent used along with acetic acid and methanol, where there is no delay for the addition of the fatty acid but some interval between the addition of water and the addition of acetic acid and methanol. Example B in the '514 patent and example 1 in the '467 patent both describe a process where water and the fatty acid converting agent are added to other ingredients (including the overbased calcium sulfonate and base oil), then heated to around 140-145° F. before adding acetic acid followed by methanol. The mixture is then heated to around 150-160° F. until conversion is complete. The amount of overbased calcium sulfonate in the final grease products in both examples is 32.2, which is higher than desirable. These patents do not state the duration of delay between the addition of water and fatty acid and the addition of the acetic acid and methanol, but indicates that the addition was immediate after an unspecified period of heating. Similar processes are disclosed in example A of the '467 patent and example C of the '514 patent except all of the fatty acid was added post conversion, so the only non-aqueous converting agents used were the acetic acid and methanol added after the mixture with water was heated to 140-145 F. The amount of overbased calcium sulfonate in these examples is even higher than the previous examples at 40%. In addition to not achieving ideal thickener yield results, all these processes use methanol as a converting agent, which has environmental drawbacks. The use of volatile alcohols as converting agents may result in venting these ingredients to the atmosphere as a later part of the grease-making process, which is prohibited in many parts of the world. If not vented, the alcohols must be recovered by water scrubbing or water traps, which results in hazardous material disposal costs. As such, there is a need for a process that achieves better thickener yields, preferably without requiring the use of volatile alcohols as converting agents.

Better thickener yields are achieved in example 10 of the '514 patent, but the use of excess lime is taught as a requirement to achieve those results. In that example, water and excess lime are added together with other ingredients, the mixture is heated to 180-190 F while slowly adding acetic acid during the heating period. The resulting grease contained 23% overbased calcium sulfonate. While this thickener yield is better than others, there is still room for greater improvement without requiring the use of excess lime, which the '514 patent teaches as a requirement.

The other examples in '514 and '467 patents where there are thickener yields of 23% or less either involve the use of a pressurized kettle during conversion or are like the much greater part of the other prior art where there is no "delay" between the addition of water and the non-aqueous converting agents or both. These examples involve adding water and a fatty acid converting agent, mixing for 10 minutes without heating, and then adding acetic acid, either in a pressurized kettle or without pressure. Neither of these patents recognizes any benefit or advantage to the 10 minute interval for adding acetic acid, or the other heating delays in the examples discussed above, rather these patents focus the use of a fatty acid as a converting agent and the benefits of adding the fatty acid pre-conversion, post-conversion, or both as the reason for any observed yield improvements. Additionally, as discussed below, this 10 minute mixing interval without any heating is not a "delay" as that term is used herein, but is considered to be the same as adding the ingredients at the same time, recognizing that adding each ingredient takes at least some time and cannot occur instantaneously.

Additionally, the known prior art always teaches the use of calcium oxide or calcium hydroxide as the sources of basic calcium for production of calcium sulfonate greases or as a required component for reacting with complexing acids to form calcium sulfonate complex greases. The known prior art teaches that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. As disclosed in co-pending U.S. application Ser. Nos. 13/664,574 and 13/664,768, the known prior art generally teaches that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease as described in the '574 and '768 applications.

There are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate is not the sole added calcium containing base for reacting with complexing acids in the '062 patent. In fact, the added calcium carbonate is specifically not added as a basic reactant for reaction with complexing acids. Instead, added calcium hydroxide is required as the specific calcium-containing base for reaction with all the complexing acids. Additionally, the resulting NGLI No. 2 grease contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in copending '574 application, superior greases may be formed by the addition of micron sized calcium carbonate without requiring the use of the very expensive nano-sized particles and when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4,902,435; 4,904,399; 4,929,371 all teach using tricalcium phosphate as an additive for lubricating greases. However, it is believed that no prior art references teach the use of calcium hydroxyapatite, having the formula $Ca_5(PO_4)_3OH$ or a mathematically equivalent formula with a melting point of around 1100 C, as a calcium-containing base for reaction with acids to make lubricating greases, including calcium sulfonate-based greases. There are several prior art references assigned to Showa Shell Sekiyu in Japan, including U.S. Patent Application Publication No. 2009/0305920, that describe greases containing tricalcium phosphate, $Ca_3(PO_4)_2$, and reference a "hydroxyapatite" having the formula $[Ca_3(PO_4)_2]_3.Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '768 application and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

Additionally, it is desirable to have a calcium sulfonate complex grease composition and method of manufacture that results in both improved thickener yield and dropping point. Many of the known prior art compositions require an amount of overbased calcium sulfonate of least 36% (by weight of the final grease product) to achieve a suitable grease in the NGLI No. 2 category with a demonstrated dropping point of at least 575 F. The overbased oil-soluble calcium sulfonate is one of the most expensive ingredients in making calcium sulfonate grease, therefore it is desirable to reduce the amount of this ingredient while still maintaining a desirable level of firmness in the final grease (thereby improving thickener yield). In order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

SUMMARY OF THE INVENTION

This invention relates to overbased calcium sulfonate greases and methods for manufacturing such greases to provide improvements in both thickener yield (requiring less overbased calcium sulfonate while maintaining acceptable penetration measurements) and expected high temperature utility as demonstrated by dropping point. According to one preferred embodiment of the invention, a simple calcium sulfonate grease is produced by reacting and mixing certain compounds comprising: (a) a primary overbasing material comprising overbased oil-soluble calcium sulfonate having dispersed amorphous calcium carbonate; (b) optionally, a suitable base oil, if needed, so as to provide acceptable consistency to the product after conversion (any amount of added base oil may be added before conversion, after conversion, or both); (c) water as a converting agent; and (d) one or more other converting agents (non-aqueous converting agents), wherein there is one or more delay periods between the pre-conversion addition of the water and the pre-conversion addition of at least a portion of the one or more other non-aqueous converting agents. As used herein, "non-aqueous converting agent" means any converting agent other than water and includes converting agents that may contain some water as a diluent or an impurity.

According to yet another embodiment of the invention, complex calcium sulfonate grease is produced by reacting and mixing certain compounds comprising: (a) a primary overbasing material comprising overbased oil-soluble calcium sulfonate having dispersed amorphous calcium carbonate; (b) optionally, a suitable base oil, if needed, so as to provide acceptable consistency to the product after conversion (any amount of added base oil may be added before conversion, after conversion, or both); (c) water as a converting agent; (d) one or more other converting agents (non-aqueous converting agents); (d) one or more complexing acids; and (e) one or more added calcium containing bases for reacting with the complexing acid(s); wherein there is one or more delay periods between the pre-conversion addition of the water and the pre-conversion addition of at least a portion of the one or more other non-aqueous converting agents. All of one or more the complexing acids may be added prior to conversion or after conversion. Alternatively, a portion of one of more of the complexing acids may be added prior to conversion of the complex calcium sulfonate grease, with the remainder of the one or more complexing acids added after conversion. All of the one or more calcium containing bases may be added prior to conversion or after conversion. Alternatively, a portion of one or more of the calcium containing bases may be added prior to conversion, with the remainder added after conversion. Calcium hydroxyapatite, added calcium carbonate, added calcium hydroxide, added calcium oxide, or a combination thereof may be used as the calcium containing bases for reacting with the complexing acids. It is preferred that an excess amount of calcium hydroxide relative to the total amount of complexing acids used not be added prior to conversion.

According to another preferred embodiment, one or more of the delay periods (time between pre-conversion addition of water and pre-conversion addition of at least a portion of a non-aqueous converting agent) is a temperature adjustment delay period or a holding delay period or both. If additional water is added pre-conversion to make up for evaporation losses during the manufacturing process, those additions are not used in re-starting or determining delay periods, and only the first addition of water is used as the starting point in determining delay periods. The delay periods may involve multiple temperature adjustment delay periods and/or multiple holding delay periods. For example, a first temperature adjustment delay period is the amount of time after water is added that it takes to heat the mixture to a temperature or range of temperatures (the first temperature). A first holding delay period is the amount of time the mixture is held at the first temperature before being heated or cooled to another temperature or before adding at least a portion of a non-aqueous converting agent. A second temperature adjustment delay period is the amount of time after the first holding delay period that it takes to heat or cool the mixture to another temperature or temperature range (the second temperature). A second holding delay period is the amount of time the mixture is held at the second temperature before being heated or cooled to another temperature or before adding at least a portion of a non-aqueous converting agent. Additional temperature adjustment delay periods or holding delay periods (i.e. a third temperature adjustment delay period) follow the same pattern. Generally, a holding delay period will be followed or preceded by a temperature adjustment delay period and vice versa, but there may be two holding delay periods back to back or two temperature adjustment periods back to back. For example, the mixture may be held at ambient temperature for 30 minutes prior to adding one non-aqueous converting agent (a first holding delay period) and may continue to be held at ambient temperature for another hour prior to adding the same or a different non-aqueous converting agent (a second holding delay period). Additionally, the mixture may be heated or cooled to a first temperature after which a non-aqueous converting agent is added (a first temperature adjustment period) and then the mixture is heated or cooled to a second temperature after which the same or a different non-aqueous converting agent is added (a second temperature adjustment period, without any interim holding period). Additionally, a portion of a non-aqueous converting agent need not be added after every delay period, but may skip delay periods prior to addition or between additions. For example, the mixture may be heated to a temperature (first temperature adjustment delay period) and then held at that temperature for a period of time (a first holding delay period) before adding any non-aqueous converting agent.

According to one preferred embodiment, the first temperature may be ambient temperature or another temperature. Any subsequent temperature may be higher or lower than the previous temperature. The final pre-conversion temperature (for non-pressurized production) will be between about 190° F. and 220° F. or up to 230° F., as the temperature at which conversion in an open kettle typically occurs. Final pre-conversion temperatures can be below 190 F, however such process conditions will usually result in significantly longer conversion times, and thickener yields may also be diminished. If a portion of a non-aqueous converting agent is added immediately after reaching a temperature or range of temperatures, then there is no holding time delay for that particular temperature and that portion of the non-aqueous converting agent; but if another portion is added after holding at that temperature or range of temperatures for a period of time then there is a holding time delay for that temperature and that portion of the non-aqueous converting agent. A portion of one or more non-aqueous converting agents may be added after any temperature adjustment delay period or holding delay period and another portion of the same or a different non-aqueous converting agent may be added after another temperature adjustment delay period or holding delay period.

According to another preferred embodiment, at least a portion of a non-aqueous converting agent is added after the mixture is heated to the final pre-conversion temperature range between about 190 F and 230 F. According to another preferred embodiment, no amount of non-aqueous converting agent is added at substantially the same time as the water and there is at least one delay period prior to the addition of any non-aqueous converting agent. According to another preferred embodiment, when at least one of the non-aqueous converting agents is a glycol (e.g. propylene glycol or hexylene glycol), a portion of the glycol is added at substantially the same time as the water and another portion of glycol and all of any other non-aqueous converting agents are added after at least one delay period. According to another preferred embodiment, when acetic acid is added pre-conversion, it is added at substantially the same time as the water, and another (different) non-aqueous converting agent is added after a delay period. According to another preferred embodiment, alcohols are not used as non-aqueous converting agents.

According to one preferred embodiment, all or a portion of the non-aqueous converting agents are added in a batch manner (all at once, en masse, as opposed to a continuous addition over the course of a delay period, described below) after a delay period. It is noted, however, that in large or commercial scale operations, it will take some time to complete the batch addition of such non-aqueous converting agents to the grease batch because of the volume of materials involved. In batch addition, the amount of time it takes to add the non-aqueous converting agent to the grease mixture is not considered a delay period. In that case, any delay prior to the addition of that non-aqueous converting agent or portion thereof ends at the start time of the batch addition of the non-aqueous converting agent. According to another preferred embodiment, at least one or a portion of one non-aqueous converting agent is added in a continuous manner during the course of a delay period (either a temperature adjustment delay period or a holding delay period). Such continuous addition may be by slowly adding the non-aqueous converting agent at a substantially steady flow rate or by repeated, discrete, incremental additions during a temperature adjustment delay period, a holding delay period, or both. In that case, the time it takes to fully add the non-aqueous converting agent is included in the delay period, which ends when the addition of non-aqueous converting agent is complete. According to yet another preferred embodiment at least a portion of one non-aqueous converting agent is added in a batch manner after a delay period and at least another portion of the same or a different non-aqueous converting agent is added in a continuous manner during a delay period.

According to another preferred embodiment of the invention, improved thickener yield results are achieved using at least one delay period even when the overbased calcium sulfonate is considered to be of "poor quality." Certain overbased oil-soluble calcium sulfonates marketed and sold for the manufacture of calcium sulfonate-based greases can provide products with unacceptably low dropping points when prior art calcium sulfonate technologies are used. Such overbased oil-soluble calcium sulfonates are referred to as "poor quality" overbased oil-soluble calcium sulfonates throughout this application. When all ingredients and methods are the same except for the commercially available batch of overbased calcium sulfonate used, overbased oil-soluble calcium sulfonates producing greases having higher dropping points (above 575 F) are considered to be "good" quality calcium sulfonates for purposes of this invention and those producing greases having lower dropping points are considered to be "poor" quality for purposes of this invention. Several examples of this are provided in the '768 application, which is incorporated by reference. Although comparative chemical analyses of good quality and poor quality overbased oil-soluble calcium sulfonates has been performed, it is believed that the precise reason for this low dropping point problem has not been proven. While most commercially available overbased calcium sulfonates are considered to be good quality, it is desirable to achieve both improved thickener yield and higher dropping points regardless of whether a good quality or a poor quality calcium sulfonate is used. It has been found that both improved thickener yield and higher dropping point may be achieved with either a good quality or a poor quality calcium sulfonate when the delayed addition methods according to the invention are used. Indeed, the results of the examples using a poor quality overbased calcium sulfonate even demonstrate better thickener yields than those using a good quality overbased calcium sulfonate when using at least some of the preferred embodiments of this invention. According to another preferred embodiment, when at least one of the non-aqueous converting agents is a glycol (e.g. propylene glycol or hexylene glycol), all of the glycol is added after at least one delay period (none is added with the water) and a poor quality calcium sulfonate is used.

When produced in accordance with the parameters of the invention described herein, consistently high quality calcium sulfonate greases may be made with thickener yield and dropping point properties superior to those of prior art greases. The overbased calcium sulfonate complex greases made according to preferred embodiments of the invention have an NLGI No. 2 grade consistency (or better, i.e. harder) and a dropping point of 575° F. (or higher), with the percentage of overbased oil-soluble calcium sulfonate being between about 10% and 45% when made in an open vessel (without pressure). More preferably the amount of overbased oil-soluble calcium sulfonate in greases made according to preferred embodiments of the invention is at least around 10% but around 36% or less, more preferably around 30% or less, and most preferably around 22% or less when made in an open vessel (without pressure). These improved thickener yields are achievable with both good quality and poor quality overbased calcium sulfonates. Even greater thickener yield may be achieved with the methods of the invention when the grease is made in a pressurized vessel. Most preferably a dropping point in excess of 650 F is achieved. The lower concentrations of the overbased oil-soluble calcium sulfonate achieved by the invention are desirable since the cost of the grease is reduced. Other properties such as mobility and pumpability, especially at lower temperatures, may also be favorably impacted by the improved thickener yield achieved according to the invention.

The overbased calcium sulfonate simple greases made according to preferred embodiments of the invention have an NLGI No. 2 grade consistency and a dropping point of 575° F. (or higher), with the percentage of overbased oil-soluble calcium sulfonate being between about 30% and 70% and most preferably between about 45% and 54%. If a softer grease is desired, then a less percentage of overbased oil soluble calcium sulfonate will be needed, as well-understood by those of ordinary skill in the art. While this invention deals primarily with greases made in open vessels, it may also be used in closed vessels where heating under pressure is accomplished. The use of such pressurized vessels may result in even better thickener yields. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

DESCRIPTION OF THE PREFERRED EMBODIMENTS

According to one preferred embodiment of the invention, a simple calcium sulfonate grease is produced by reacting and mixing certain compounds comprising: (a) a primary overbasing material comprising overbased oil-soluble calcium sulfonate having dispersed amorphous calcium carbonate; (b) optionally, a suitable base oil, if needed, so as to provide acceptable consistency to the product after conversion (any amount of added base oil may be added before conversion, after conversion, or both); (c) water as a converting agent; and (d) one or more other converting agents (non-aqueous converting agents), with there being one or more delay periods between the pre-conversion addition of the water and the addition of at least a portion of the one or more other non-aqueous converting agents.

According to another preferred embodiment of the invention, complex calcium sulfonate grease is produced by reacting and mixing certain compounds comprising: (a) a primary overbasing material comprising overbased oil-soluble calcium sulfonate having dispersed amorphous calcium carbonate; (b) optionally, a suitable base oil, if needed, so as to provide acceptable consistency to the product after conversion (any amount of added base oil may be added before conversion, after conversion, or both); (c) water as a converting agent; (d) one or more other converting agents (non-aqueous converting agents), with there being one or more delay periods between the pre-conversion addition of the water and the addition of at least a portion of the one or more other non-aqueous converting agents; (e) one or more complexing acids; and (f) one or more added calcium containing bases for reacting with the complexing acid(s). A portion of one of more of the complexing acids may be added prior to conversion of the complex calcium sulfonate grease, with the remainder of the one or more complexing acids added after conversion. Calcium hydroxyapatite, added calcium carbonate, added calcium hydroxide, added calcium oxide, or a combination thereof may be used as the calcium containing bases for reacting with the complexing acids.

In both the simple and complex greases, some or all of the ingredients, including converting agents, may not be in the final finished product due to evaporation and volatilization during manufacture. Optionally, for either simple or complex greases, a facilitating acid may be added prior to conversion according to another embodiment of the invention. Such facilitating acid aids in grease structure formation. For both the simple and complex greases according to the invention, there are one or more delay periods between the pre-conversion addition of the water and the addition of at least a portion of the one or more other non-aqueous converting agents. The mixture is also most preferably heated to a temperature or temperature range during at least one of the delay periods or during each delay period, as described below with respect to the preferred methods for making calcium sulfonate greases according to the invention. Most preferably, one or more of the delay periods (time between pre-conversion addition of water and addition of at least a portion of a non-aqueous converting agent) is a temperature adjustment delay period or a holding delay period or both. The delay periods may involve multiple temperature adjustment delay periods and multiple holding delay periods. For example, a first temperature adjustment delay period is the period of time after water is added that it takes to change the temperature of the mixture (typically by heating) to a desired temperature or range of temperatures (the first temperature). A first holding delay period is the amount of time the mixture is held at the first temperature. A second temperature adjustment delay period is the period of time after the first holding delay that it takes to heat or cool the mixture to another temperature or temperature range (the second temperature). A second holding delay period is the amount of time the mixture is held at the second temperature. Additional temperature adjustment delay periods and holding delay periods (i.e. a third temperature adjustment delay period) follow the same pattern. The first temperature may be ambient temperature or an elevated temperature. Any subsequent temperature may be higher or lower than the previous temperature. The final pre-conversion temperature will be between about 190° F. and 220° F. or up to 230° F., as the temperature at which conversion in an open kettle typically occurs. Any combination of temperature adjustment delay periods and/or holding delay periods may be used.

If a non-aqueous converting agent or portion thereof is added immediately after reaching a temperature or range of temperatures, then there is no holding delay period for that particular temperature. A portion of one or more non-aqueous converting agents may be added after any temperature adjustment delay period or holding delay period and another portion of the same or a different non-aqueous converting agent may be added after another temperature adjustment delay period or holding delay period. Generally, the duration of each temperature adjustment delay period will be about 30 minutes to 24 hours, or more typically about 30 minutes to 5 hours. However, the duration of any temperature adjustment delay period will vary depending on the size of the grease batch, the equipment used to mix and heat the batch, and the temperature differential between the starting temperature and final temperature, as will be understood by those of ordinary skill in the art. Preferred embodiments regarding the delay period(s) are further discussed below in relation to preferred methods for making greases according to the invention.

The highly overbased oil-soluble calcium sulfonate used according to these embodiments of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sultanates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease. The overbased calcium sulfonate used may be of a good quality or a poor quality as defined herein and in the 768 application.

The amount of the highly overbased oil-soluble calcium sulfonate in the final complex grease according to an embodiment of the invention can vary, but is generally between 10 and 45%. Preferably, the amount of the highly overbased oil-soluble calcium sulfonate in the final complex grease according to an embodiment of the invention is around 36% or less, more preferably around 30% or less, and most preferably around 22% or less when made in an open vessel (without pressure), with even smaller percentages achievable when made in pressurized vessels. The amount of the highly overbased oil-soluble calcium sulfonate in the final simple grease according to an embodiment of the invention can vary, but is generally between 30 and 70%, more preferably less than 60% and most preferably less than 55%.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) will typically be between 30% and 70%, preferably 45% and 70%, most preferably 50% and 70%, based on the final weight of the grease.

Typically, the amount of base oil added as a separate ingredient will increase as the amount of overbased calcium sulfonate decreases.

Water is added to the preferred embodiments of the invention as one converting agent. One or more other non-aqueous converting agents is also preferably added in these embodiments of the invention. The non-aqueous converting agents include any converting agent other than water, such as alcohols, ethers, glycols, glycol ethers, glycol polyethers, carboxylic acids, inorganic acids, organic nitrates, and any other compounds that contain either active or tautomeric hydrogen. Non-aqueous converting agents also include those agents that contain some water as a diluent or impurity. Although they may be used as non-aqueous converting agents, it is preferred not to use alcohols, such as methanol or isopropyl alcohol or other low molecular weight (i.e. more volatile) alcohols, because of environmental concerns and restrictions related to venting gases during the grease manufacturing process or hazardous waste disposal of scrubbed alcohols. The total amount of water added as a converting agent, based on the final weight of the grease, is between 1.5% and 10%, preferably between 2.0% and 5.0%, most preferably between 2.2% and 4.5%. Additional water may be added after conversion. Also, if the conversion takes place in an open vessel at a sufficiently high temperature so as to volatilize a significant portion of the water during conversion, additional water may be added to replace the water that was lost. The total amount of one or more non-aqueous converting agents added, based on the final weight of the grease, is between 0.1% and 5%, preferably 0.5% and 4%, most preferably 1.0% and 3.0%. Typically, the amount of non-aqueous converting agent used will decrease as the amount of overbased calcium sulfonate decreases. Depending on the converting agents used, some or all of them may be removed by volatilization during the manufacturing process. Especially preferred are the lower molecular weight glycols such as hexylene glycol and propylene glycol. It should be noted that some converting agents may also serve as complexing acids, to produce a calcium sulfonate complex grease according to one embodiment of the invention, discussed below. Such materials will simultaneously provide both functions of converting and complexing.

Although not required, a small amount of a facilitating acid may be added to the mixture prior to conversion according to another embodiment of the invention. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion in an amount from about 0.50% to 5.0%, preferably 1.0% to 4.0%, most preferably 1.3% to 3.6%, based on the final weight of the grease. If the calcium sulfonate is made in situ using alkyl benzene sulfonic acid, the facilitating acid added according to this embodiment is in addition to that required to produce the calcium sulfonate.

When making a complex calcium sulfonate grease according to another preferred embodiment of the invention, one or more complexing acids and one or more calcium containing bases are also added. The calcium containing bases may include calcium hydroxyapatite, added calcium carbonate, added calcium hydroxide, added calcium oxide, or a combination of one or more of the foregoing. The calcium hydroxyapatite used as a calcium containing base for reacting with complexing acids according to this embodiment may be added pre-conversion, post-conversion, or a portion added pre- and a portion added post-conversion. Most preferably, the calcium hydroxyapatite is finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will be between 2.0% and 20%, preferably 4% and 15%, most preferably 5% and 10%, based on the total weight of the grease, although more can be added, if desired, after conversion and all reaction with complexing acids is complete.

According to another embodiment of the invention, calcium hydroxyapatite may be added to the above ingredients in an amount that is insufficient to fully react with the complexing acids. In this embodiment, finely divided calcium carbonate as an oil-insoluble solid calcium-containing base may be added, preferably before conversion, in an amount sufficient to fully react with and neutralize the portion of any subsequently added complexing acids not neutralized by the calcium hydroxyapatite.

According to another embodiment, calcium hydroxyapatite may be added to the above ingredients in an amount that is insufficient to fully react with the complexing acids. In this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. In this embodiment, the calcium hydroxide and/or calcium oxide preferably represents no more than 75% of the hydroxide equivalent basicity provided by the total of the added calcium hydroxyapatite, calcium hydroxide, and calcium oxide. In another embodiment, calcium carbonate may also be added with the calcium hydroxyapatite, calcium hydroxide and/or calcium oxide, with the calcium carbonate being added either before or after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium carbonate used as a calcium containing base, either alone or in combination with another calcium containing base or bases, according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is between 2.0% and 20%, preferably 4% and 15%, most preferably 6% and 10%, based on the final weight of the grease. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate that is added prior to conversion and as one of or the sole added calcium-containing base for reaction with complexing acids when making a complex grease according to the invention.

The added calcium hydroxide and/or added calcium oxide added pre-conversion according to another embodiment shall be finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will be between 0.07% and 1.00%, preferably 0.15% and 0.85%, most preferably 0.18% and 0.40%, based on the total weight of the grease. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite may be used as the sole added calcium containing base for such reaction or may be used in combination for such reaction.

Complexing acids used in these embodiments will comprise at least one and preferably two or more of the following: long chain carboxylic acids, short chain carboxylic acids, boric acid, and phosphoric acid. Acetic acid and other carboxylic acids may be used as a converting agent or complexing acid or both, depending on when it is added. Similarly, some complexing acids (such as the 12-hydroxystearic acid in the '514 and '467 patents) may be used as converting agents. The total amount of complexing acids added is preferably between 2.8% and 11% by weight of the final grease. The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The amount of long chain carboxylic acid is between 0.5% and 5.0%, preferably 1.0% to 4.0%, most preferably 2.0% to 3.0%, based on the final weight of the grease.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. The amount of short chain carboxylic acids is between 0.05% and 2.0%, preferably 0.1% to 1.0%, most preferably 0.2% to 0.5%, based on the final weight of the grease. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture.

If boric acid is used as a complexing acid according to this embodiment, an amount between 0.4% to about 4.0%, preferably 0.7% to 3.0%, and most preferably 1.0% and 2.5%, based on the final weight of the grease, is added. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, berated epoxides, berated peroxides and the like may be used instead of boric acid. If phosphoric acid is used as a complexing acid, an amount between 0.4% to 4.0%, preferably 1.0% and 3.0%, most preferably 1.4% and 2.0%, based on the final weight of the grease, is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention.

The calcium sulfonate grease compositions are preferably made according to the methods of the invention described herein. All percentages are based on the final weight of the finished grease unless otherwise indicated. One preferred method of making a simple grease or a complex grease comprises mixing water, less than 30% overbased calcium sulfonate containing dispersed amorphous calcium carbonate for a complex grease or between 30% and 70% overbased calcium sulfonate containing dispersed amorphous calcium carbonate for a simple grease, and optionally base oil to form a first mixture; adding at least a portion of one or more non-aqueous converting agents to the first mixture after one or more delay periods to form a pre-conversion mixture; and converting the pre-conversion mixture to a converted mixture by heating until conversion of the amorphous calcium carbonate contained in the overbased calcium sulfonate to crystalline calcium carbonate has occurred.

Another preferred method of making a simple grease or a complex grease comprises mixing water, less than 45% overbased calcium sulfonate containing dispersed amorphous calcium carbonate for a complex grease or between 30% and 70% overbased calcium sulfonate containing dispersed amorphous calcium carbonate for a simple grease, and optionally base oil to form a first mixture; adding at least a portion of one or more non-aqueous converting agents to the first mixture after or during one or more delay periods to form a pre-conversion mixture; converting the pre-conversion mixture to a converted mixture by heating until conversion of the amorphous calcium carbonate contained in the overbased calcium sulfonate to crystalline calcium carbonate has occurred, with at least one of the delay periods being a holding delay period where the first mixture or pre-conversion mixture is maintained at a temperature or within a range of temperatures for a period of time.

Another preferred method of making a simple grease or a complex grease comprises mixing water, less than 22% overbased calcium sulfonate containing dispersed amorphous calcium carbonate for a complex grease or between 30% and 70% overbased calcium sulfonate containing dispersed amorphous calcium carbonate for a simple grease, and optionally base oil to form a first mixture; adding at least a portion of one or more non-aqueous converting agents to the first mixture after or during one or more delay periods to form a pre-conversion mixture; converting the pre-conversion mixture to a converted mixture by heating until conversion of the amorphous calcium carbonate contained in the overbased calcium sulfonate to crystalline calcium carbonate has occurred.

Another preferred method of making a simple grease comprises the steps of: (1) admixing in a suitable grease manufacturing vessel the following ingredients: water as a converting agent, a highly overbased oil-soluble calcium sulfonate containing dispersed amorphous calcium carbonate, optionally an appropriate amount of a suitable base oil (if needed), and optionally at least a portion of one or more non-aqueous converting agents to form a first mixture; (2) mixing or stirring the first mixture while maintaining it at a temperature or within a range of temperatures and/or adjusting the temperature of the first mixture to heat or cool it to another temperature(s) or range of temperatures during one or more delay periods; (3) optionally admixing at least a portion of one or more non-aqueous converting agents with the first mixture after or during one or more delay periods to form a second mixture; (4) heating the first mixture (or second mixture if non-aqueous converting agents are added in step 3) to a conversion temperature (preferably in the range of 190 F to 230 F, higher than the typical range of 190 F to 220 F, for an open vessel) to form a third mixture during the final of the one or more delay periods; (5) after or during step 4, admixing all or any remaining portion (if any) of the one or more non-aqueous converting agents; and (6) converting the third mixture by continuing to mix while maintaining the temperature in the conversion temperature range (preferably 190 F to 230 F) until conversion of the amorphous calcium carbonate contained in the overbased calcium sulfonate to very finely divided crystalline calcium carbonate is complete. This process results in a preferred simple calcium sulfonate grease. This preferred method also optionally includes the steps of (7) admixing added calcium carbonate and/or (8) admixing a facilitating acid. Step (7) may be carried out at any time prior to conversion, after conversion or a portion may be added prior to conversion and another portion added after conversion. Step (8) may be carried out at any time prior to conversion. Most preferably, this method is carried out in an open vessel, but may also be carried out in a pressurized vessel.

One preferred method of making a complex grease according to the invention comprises steps of: (1) admixing in a suitable grease manufacturing vessel the following ingredients: water as a converting agent, a highly overbased oil-soluble calcium sulfonate containing dispersed amorphous calcium carbonate, optionally an appropriate amount of a suitable base oil (if needed), and optionally at least a portion of one or more non-aqueous converting agents to form a first mixture; (2) mixing or stirring the first mixture while maintaining it at a temperature or within a range of temperatures and/or adjusting the temperature of the first mixture to heat or cool it to another temperature(s) or range of temperatures during one or more delay periods; (3) optionally admixing at least a portion of one or more non-aqueous converting agents with the first mixture after or during one or more delay periods to form a second mixture; (4) heating the first mixture (or second mixture if non-aqueous converting agents are added in step 3) to a conversion temperature (preferably in the range of 190 F to 230 F, higher than the typical range of 190 F to 220 F, for an open vessel) to form a third mixture during the final of the one or more delay periods; (5) after or during step 4, admixing all or any remaining portion (if any) of the one or more non-aqueous converting agents; and (6) converting the third mixture by continuing to mix while maintaining the temperature in the conversion temperature range (preferably 190 F to 230 F) until conversion of the amorphous calcium carbonate contained in the overbased calcium sulfonate to very finely divided crystalline calcium carbonate is complete; (7) admixing one or more calcium containing bases; (8) optionally admixing a facilitating acid; and (9) admixing one or more of suitable complexing acids. This process results in a preferred complex calcium sulfonate grease. Step (7) may be carried out prior to conversion or after conversion, or some portion or all of one or more calcium containing bases may be added prior to conversion and some portion or all of one or more calcium containing bases may be added after conversion. Step (8) may be carried out at any time prior to conversion. Step (9) may be carried out prior to conversion or after conversion, or some portion or all of one or more of the complexing acids may be added prior to conversion and some portion or all of one or more of the complexing acids added after conversion. Most preferably, this method is carried out in an open vessel, but may also be carried out in a pressurized vessel.

According to several other embodiments, the method for making a complex grease is the same as above except that step (7) involves one of the following: (a) admixing finely divides calcium hydroxyapatite prior to conversion as the only calcium containing base added; (b) admixing finely divided calcium hydroxyapatite and calcium carbonate in an amount sufficient to fully react with and neutralize subsequently added complexing acids, according to one embodiment; (c) admixing finely divided calcium hydroxyapatite and calcium hydroxide and/or calcium oxide in an amount sufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, according to another embodiment of the invention; (d) admixing added calcium carbonate after conversion, according to another embodiment of the invention; or (e) admixing calcium hydroxyapatite after conversion and in an amount sufficient to completely react with and neutralize any complexing acids added post-conversion, according to yet another embodiment of the invention. According to another embodiment, the method for making a complex grease is the same as above except that finely divided calcium carbonate as an oil-insoluble solid calcium-containing base is added prior to conversion (before or during step 6) and step (7) involves admixing finely divided calcium hydroxyapatite and calcium hydroxide and/or calcium oxide in an amount insufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, with the previously added calcium carbonate being added in an amount sufficient to fully react with and neutralize the portion of any subsequently added complexing acids not neutralized by the calcium hydroxyapatite and calcium hydroxide and/or calcium oxide.

Another preferred method of making a complex grease according to the invention comprises steps of: admixing in a suitable grease manufacturing vessel a highly overbased oil-soluble calcium sulfonate containing dispersed amorphous calcium carbonate and an amount of suitable base oil (if needed) and begin mixing. Then one or more facilitating acids are added and mixed, preferably for about 20-30 minutes. Then all of the calcium hydroxyapatite is added, followed by a portion of the calcium hydroxide, and then all of the calcium carbonate, which is mixed for another 20-30 minutes. Next a portion of the acetic acid and a portion of the 12-hydroxystearic acid are added and mixed for another 20-30 minutes (it is noted that these ingredients may be converting agents, but since they are added before the water there is no delay period). Then water is added as a converting agent and mixed while heating to a temperature between 190° F. and 230° F. (a first temperature adjustment delay period and the final delay period). Then all of the hexylene glycol is added as a non-aqueous converting agent. The mixture is converted by continuing to mix while maintaining the temperature in the conversion temperature range (preferably 190 F to 230 F) until conversion of the amorphous calcium carbonate contained in the overbased calcium sulfonate to very finely divided crystalline calcium carbonate is complete After conversion, the remaining calcium hydroxide is added and mixed for about 20-30 minutes. Then the remaining acetic acid and remaining 12-hydroxystearic acid are added and mixed for around 30 minutes. Next boric acid dispersed in water is added followed by the slow, gradual addition of phosphoric acid. The mixture is then heated to remove water and volatiles, cooled, more base oil is added as needed, and the grease is milled as described below. Additional additives may be added during the final heating or cooling steps. According to another preferred method of making a complex grease, the steps and ingredients are the same as outlined above except that after adding the water as a converting agent and before adding all of the hexylene glycol as a non-aqueous converting agent, the mixture is heated to around 160° F. (a first temperature adjustment delay period) and held at that temperature for around 30 minutes (a first holding delay period) before continuing to heat to between 190° F. and 230° F. (a second temperature adjustment delay period and the final delay period).

For both the simple grease and complex grease embodiments according to the invention, any portion of a non-aqueous converting agent added in steps 1, 3, and/or 5 may be the same non-aqueous converting agent as that added in another step or steps or different from any non-aqueous converting agent added in another step or steps. Provided that at least a portion of at least one non-aqueous converting agent is added after a delay period (in step 3 or step 5), another portion of the same and/or at least a portion of a different non-aqueous converting agent or agents may be added in any combination of steps 1, 3, and/or 5. According to another preferred embodiment for either a simple grease or a complex grease, all of the one or more of the non-aqueous converting agents are admixed after the final delay period in step 5, with none being added during steps 1 or 3. According to another preferred embodiment for either a simple grease or a complex grease, at least a portion of one or more non-aqueous converting agents is added with the first mixture in step 1 prior to any delay and at least a portion of the same or a different non-aqueous converting agent is added in step 3 and/or in step 5. According to another preferred embodiment for either a simple grease or a complex grease, no non-aqueous converting agents are added with the first mixture and at least a portion of one or more non-aqueous converting agents is added is added in step 3 and in step 5. According to another preferred embodiment for either a simple grease or a complex grease, at least a portion of one or more non-aqueous converting agents is added after or during one delay period in step 3 and at least a portion of the same or a different non-aqueous converting agent is added after or during another delay period (a second delay period in step 3 and/or a final delay period in step 5). According to another preferred embodiment for either a simple grease or a complex grease, at least a portion of one or more non-aqueous converting agents is added after one or more delays in step 3, but no non-aqueous converting agents are added after the final delay period in step 5.

Most preferably, the method of making a complex and a simple grease also includes the steps of: (a) mixing and heating to a temperature sufficiently high to insure removal of water and any volatile reaction byproducts and optimize final product quality; (b) cooling the grease while adding additional base oil as needed; (c) adding remaining desired additives as are well known in the art; and, if desired, (d) milling the final grease as required to obtain a final smooth homogenous product. Although the order and timing of these steps is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

According to another preferred embodiment for use with either the simple or complex grease methods, one or more of the delay periods (time between pre-conversion addition of water and addition of at least a portion of a non-aqueous converting agent) is a temperature adjustment delay period or a holding delay period or both. The delay periods may involve multiple temperature adjustment delay periods and multiple holding delay periods. For example, a first temperature adjustment delay period is the period of time after water is added that it takes to adjust the temperature of the mixture (typically by heating) to a temperature or range of temperatures (the first temperature). A first holding delay period is the amount of time the mixture is held at the first temperature. A second temperature adjustment delay period is the period of time after the first holding delay that it takes to heat the mixture to another temperature or temperature range (the second temperature). A second holding delay period is the amount of time the mixture is held at the second temperature. Additional temperature adjustment delay periods or holding delay periods (i.e. a third temperature adjustment delay period) follow the same pattern. The first temperature may be ambient temperature (in which case there is no first temperature adjustment delay period). Any subsequent temperature may be higher or lower than the previous temperature. The final pre-conversion temperature will preferably be between about 190 F and 220 F or up to 230 F, as the temperature at which conversion in an open kettle typically occurs.

If a non-aqueous converting agent or portion thereof is added immediately after reaching a temperature or range of temperatures, then there is no holding delay period for that particular temperature. All of or a portion of one or more non-aqueous converting agents may be added after any temperature adjustment delay period or holding delay period and another portion of the same, or all of or a portion of a different, non-aqueous converting agent may be added after another temperature adjustment delay period or holding delay period. Most preferably the temperature adjustment delay period after which a non-aqueous converting agent is immediately added to the mixture will be the last temperature adjustment delay period (and last delay period) associated with that specific non-aqueous converting agent, but the mixture may be heated to another temperature or temperature range and additional non-aqueous converting agent(s) added to result in additional temperature adjustment delay periods and possibly additional holding delay periods.

In one preferred embodiment, at least a portion of one or more non-aqueous converting agents is added at the end of a final of the one or more delay periods and another portion of the same and/or a different non-aqueous converting agent is added after one or more prior delay periods. According to another preferred embodiment, all of the one or more non-aqueous converting agents are added at the end of a final of the one or more delay periods. According to another preferred embodiment, at least a portion of one or more non-aqueous converting agents are added at around the same time as the water is added (no delay period) and another portion of the same and/or a different non-aqueous converting agent is added after one or more prior delay periods. According to yet another preferred embodiment, at least one non-aqueous converting agent or a portion thereof is slowly added in a substantially continuous manner or in discrete, incremental amounts during a temperature adjustment delay period, a holding delay period, or both.

Although a delay period within the scope of this invention may involve a holding delay period that does not involve heating (see Example 15 below where the mixture was held at ambient temperature for a first holding delay period prior to heating to a conversion temperature range during a second temperature adjustment delay period), a short period of time of less than 15 minutes between the addition of water as a converting agent and the addition of all of the non-aqueous converting agent(s) without any heating during that time period is not a "delay" or "delay period" as used herein. A delay for the addition of any or all of the non-aqueous converting agent(s) without heating during the delay period, for purposes of this invention, should be at least about 20 minutes and more preferably at least about 30 minutes. An interval of less than 20 minutes between the addition of water and a portion of a non-aqueous converting agent, without heating during the 20 minutes, but with a subsequent longer holding delay period or subsequent heating prior to the addition of another portion of the same, or a portion or all of a different, non-aqueous converting agent(s) does involve a "delay period" within the scope of the invention. In that case, the initial short interval is not a "delay period," but the subsequent longer holding delay or temperature adjustment delay prior to addition of a non-aqueous converting agent is a holding delay period or temperature adjustment delay period for purposes of this invention. Additionally, all or some portion of one or more of the non-aqueous converting agents may be slowly added during one or more temperature adjustment delay periods or holding delay periods or both. Such slow addition may include a substantially continuous addition of the non-aqueous converting agent during the delay period(s) or repeated, incremental additions during the delay period(s).

Additionally, when acetic acid or 12-hydroxystearic acid are added pre-conversion, these acids acid will have a dual role as both converting agent and complexing acid. When these acids are added along with another more active non-aqueous converting agent (such as a glycol), the acid may be considered to act primarily in the role of complexing acid, with the more active agent taking on the primary role of converting agent. As such, when acetic acid or 12-hydroxystearic acid is added pre-conversion along with a more active converting agent, any elapsed time between the addition of water and any portion of the acetic acid or 12-hydroxystearic acid is not considered a delay as that term is used herein. In that case, only temperature adjustment delay periods or holding delay periods between the pre-conversion addition of water and the pre-conversion addition of any portion of the other non-aqueous converting agent are considered delays for purposes of this invention. If acetic acid or 12-hydroxystearic acid or a combination thereof is/are the only non-aqueous converting agent(s) used, then a temperature adjustment delay period or holding delay period between the pre-conversion addition of water and the pre-conversion addition of any portion of the acetic acid or 12-hydroxystearic acid would be a delay for purposes of this invention.

The order of steps (2)-(6) for both the simple grease and complex grease, wherein there is a delayed addition of at least a portion of the non-aqueous converting agent(s) relative to the addition of the water as a converting agent (either with or without interim temperature adjustment), are important aspects of the invention. Certain other aspects of the process are not critical to obtaining a preferred calcium sulfonate grease compositions according to the invention. For instance, the order that the calcium containing bases are added relative to each other is not important. Also, the temperature at which the water as a converting agent and calcium containing bases are added is not critical, but it is preferred that they be added before the temperature reaches 190 F to 200 F. When more than one complexing acid is used, the order in which they are added either before or after conversion is also not generally critical. These processes may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium sulfonate greases, where pressurized reactions are not as important, may limit a plant's ability to make other greases where those reactions are important. These issues are avoided with open vessels.

Examples 1-18 in the '574 application and 1-29 in the '768 application are incorporated herein by reference. The overbased calcium sulfonate grease compositions and methods for making such compositions according to the invention are further described and explained in relation to the following examples:

Example 1

A calcium sulfonate complex grease according to the composition of the invention, but without a delay period between the addition of water and the non-aqueous converting agent was made as follows: 264.61 grams of 400 TBN overbased oil-soluble calcium sulfonate were added to an open mixing vessel followed by 327.55 grams of a solvent neutral group 1 paraffinic base oil having a viscosity of about 600 SUS at 100 F, and 11.70 grams of PAO having a viscosity of 4 cSt at 100 C. The 400 TBN overbased oil-soluble calcium sulfonate was a poor quality calcium sulfonate similar to the one previously described; and used in Examples 10 and 11 of the '768 application. Mixing without heat began using a planetary mixing paddle. Then 23.94 grams of a primarily C12 alkylbenzene sulfonic acid were added. After mixing for 20 minutes, 50.65 grams of calcium hydroxyapatite with a mean particle size of around 1 to 5 microns, and 3.63 grams of food grade purity calcium hydroxide having a mean particle size of around 1 to 5 microns were added and allowed to mix in for 30 minutes. The amount of calcium hydroxide added as a separate ingredient is in addition to the amount of residual calcium hydroxide contained within the overbased calcium sulfonate. Then 0.88 grams of glacial acetic acid and 10.53 grams of 12-hydroxystearic acid were added and allowed to mix in for 10 minutes. Then 55.03 grams of finely divided calcium carbonate with a mean particle size around 1 to 5 microns were added and allowed to mix in for 5 minutes. The amount of calcium carbonate added as a separate ingredient is in addition to the amount of dispersed calcium carbonate contained within the overbased calcium sulfonate. Then 13.20 grams of hexylene glycol (a non-aqueous converting agent) and 38.22 grams water were added at the substantially the same time (no delay period). The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Due to the heaviness of the converted grease, another 56.07 grams of the same paraffinic base oil were added. Then 7.36 grams of the same calcium hydroxide were added and allowed to mix in for 10 minutes. Then 1.52 grams of glacial acetic acid were added followed by 27.30 grams of 12-hydroxystearic acid. As these acids reacted and further thickened the grease, 111.07 grams of the paraffinic base oil were added. Then 9.28 grams of boric acid was mixed in 50 grams of hot water and the mixture was added to the grease. Another 54.47 grams of paraffinic base oil were added followed by 17.92 grams of a 75% solution of phosphoric acid in water. The mixture was then heated with an electric heating mantle while continuing to stir. When the grease reached 300 F, 22.22 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.01 grams of food grade anhydrous calcium sulfate having a mean particle size of around 1 to 5 microns were added. When the temperature of the grease cooled to 200 F, 4.43 grams of a polyisobutylene polymer were added. Mixing continued until the grease reached a temperature of 170 F. The grease was then removed from the mixer and given three passes through a three-roll mill to achieve a final smooth homogenous texture. The grease had a worked 60 stroke penetration of 287. The percent overbased oil-soluble calcium sulfonate in the final grease was 23.9%. The dropping point was >650 F. In this example, calcium hydroxyapatite and calcium carbonate were added before conversion, according to an embodiment of the 768 application. Also, 33% of the total amount of calcium hydroxide was added before conversion followed by 35% of the total amount glacial acetic acid and 28% of the total amount of 12-hydroxystearic acid. The remaining amounts of calcium hydroxide, glacial acetic acid, 12-hydroxystearic acid were added after conversion Example 2

Another calcium sulfonate complex grease was made using the same equipment, raw materials, amounts, and manufacturing process as the Example 1 grease, except that there was a delay in adding the non-aqueous converting agent (hexylene glycol). The other initial ingredients (including water) were mixed and heated to a temperature of about 190° F. (a first temperature adjustment delay period) and held at that temperature for 1 hour (a first holding delay period) prior to adding the hexylene glycol. When the hexylene glycol was added, conversion occurred almost instantaneously. The grease was held at 190 F-200 F for an additional 45 minutes. Then the remaining process was the same as the previous Example 1 grease. The final grease had a worked 60 stroke penetration of 261. The percent overbased oil-soluble calcium sulfonate in the final grease was 21.1%. The dropping point was >650 F. As can be seen, the grease of this example had an improved thickener yield compared to the grease of the previous Example 1 as evidenced by the lower final percentage of overbased calcium sulfonate as compared to the worked penetration. In fact, using a linear dilution relation of worked penetration to the percentage of overbased calcium sulfonate in the final grease, the predicted percentage of overbased calcium sulfonate in the Example 2 grease would be 19.2% if it was diluted with sufficient base oil to obtain the same worked penetration of the Example 1 grease.

Example 3

Another calcium complex grease using the same equipment, raw materials, amounts, and manufacturing process as the Example 1 grease was made, except that there was a delay in adding the non-aqueous converting agent (hexylene glycol). The other initial ingredients (including water) were mixed and heated to a temperature of about 190° F. (a first temperature adjustment delay period), but unlike Example 2, the hexylene glycol was added immediately upon reaching 190° F. (no holding delay period). When the hexylene glycol was added, conversion rapidly occurred. The grease was held at 190 F-200 F for an additional 45 minutes. Then the remaining process was the same as the previous Example 1 grease. The final grease had a worked 60 stroke penetration of 290. The percent overbased oil-soluble calcium sulfonate in the final grease was 21.4%. The dropping point was >650 F. As can be seen, the grease of this example had an improved thickener yield compared to the grease of the previous Example 1 as evidenced by the lower final percentage of overbased calcium sulfonate as compared to the worked penetration.

Example 4

Another calcium sulfonate complex grease according to the composition of the invention, but without a delay period between the addition of water and the non-aqueous converting agent was made as follows: 311.67 grams of 400 TBN overbased oil-soluble calcium sulfonate were added to an open mixing vessel followed by 451.37 grams of a solvent neutral group 1 paraffinic base oil having a viscosity of about 600 SUS at 100 F, and 10.30 grams of PAO having a viscosity of 4 cSt at 100 C. The 400 TBN overbased oil-soluble calcium sulfonate was a good quality calcium sulfonate similar to the one previously described and used in Examples 4 and 12 of '768 application. Mixing without heat began using a planetary mixing paddle. Then 31.48 grams of a primarily C12 alkylbenzene sulfonic acid were added. After mixing for 20 minutes, 7.56 grams of finely divided calcium carbonate with a mean particle size around 1-5 microns were added (in addition to the amount of dispersed calcium carbonate contained in the overbased calcium sulfonate) and allowed to mix in for 20 minutes. Then 4.90 grams of 12-hydroxystearic acid were added followed by 15.50 grams of hexylene glycol (a non-aqueous converting agent) and 40.75 grams water (added at substantially the same time as the hexylene glycol—no delay period). The mixture was heated until the temperature reached 190 F. Then another 67.60 grams of calcium carbonate were added. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. An additional 5.00 grams of water was added followed by 19.60 grams 12-hydroxystearic acid, 2.40 grams glacial acetic acid, and 16.64 grams of a 75% solution of phosphoric acid in water. The mixture was then heated with an electric heating mantle while continuing to stir. When the grease reached 300 F, 27.85 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, an additional 32.75 grams of the paraffinic base oil was added. Then 5.05 grams of a polyisobutylene polymer were added. Mixing continued until the grease reached a temperature of 170 F. The grease was then removed from the mixer and given three passes through a three-roll mill to achieve a final smooth homogenous texture. The grease had a worked 60 stroke penetration of 271. The percent overbased oil-soluble calcium sulfonate in the final grease was 31.0%. The dropping point was 629 F. In this example, the added calcium carbonate was added before conversion in accordance with an embodiment of the '574 application. Also, 20% of the total amount of 12-hydroxystearic acid was added before conversion. The remaining amount of 12-hydroxystearic acid was added after conversion.

Example 5

Another calcium complex grease using the same equipment, raw materials, amounts, and manufacturing process as the Example 4 grease was made, except that there was a delay in adding the non-aqueous converting agent (hexylene glycol). The other initial ingredients (including water) were mixed and heated to a temperature of about 190° F. (a first temperature adjustment delay period) and held at that temperature for 1 hour (a first holding delay period) prior to adding the hexylene glycol. When the hexylene glycol was added, visible conversion began to occur almost immediately. The grease was held at 190 F-200 F for an additional 45 minutes after conversion appeared to be complete. Then the remaining process was the same as the previous Example 4 grease. The final grease had a worked 60 stroke penetration of 265. The percent overbased oil-soluble calcium sulfonate in the final grease was 29.2%. The dropping point was >650 F. As can be seen, the grease of this example had an improved thickener yield compared to the grease of the previous Example 4 as evidenced by the lower final percentage of overbased calcium sulfonate as compared to the worked penetration.

Example 6

Another calcium sulfonate complex grease was made using similar ingredients and methods as examples in U.S. Pat. Nos. 5,308,514 and 5,338,467 (issued to Witco Corporation on May 3, 1994 and Aug. 16, 1994, respectively), where at least a portion of the long chain fatty acid is added prior to conversion and may act as a converting agent. Specifically, 54.1% of the total amount of 12-hydroxystearic acid and all of the glacial acetic acid were added before conversion. The remaining amount of 12-hydroxystearic acid was added after conversion followed by calcium hydroxide and a boric acid water mixture. Added calcium hydroxide is used as the sole added base for reacting with complexing acids, in accordance with the scope of the '514 patent, and no calcium hydroxyapatite or added calcium carbonate was used. There was no delayed addition of non-aqueous converting agent in Example 6.

The grease of Example 6 was made as follows: 380.26 grams of 400 TBN overbased oil-soluble calcium sulfonate were added to an open mixing vessel followed by 603.6 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of '768 application. Then 21.75 grams of a primarily C12 alkylbenzene sulfonic acid were added. After mixing for 20 minutes, 21.56 grams of 12-hydroxystearic acid were added followed by 18.12 grams of hexylene glycol (a non-aqueous converting agent) and 38.45 grams water (added at substantially the same time as the hexylene glycol). After mixing for 10 minutes, 2.46 grams of glacial acetic acid was added. Then the batch was heated with continued mixing until the temperature reached 190 F. The temperature was held between 190 F and 200 F for 45 minutes. Then an additional 2.03 grams acetic acid was added, and the batch was mixed until Fourier Transform Infrared (FTIR) spectroscopy indicated that the conversion of the amorphous calcium carbonate to crystalline calcium carbonate (calcite) had occurred. An additional 248.29 grams of the paraffinic base oil was added followed by 18.29 grams 12-hydroxystearic acid. This was allowed to mix in for 15 minutes while keeping the temperature at between 190 F and 200 F. Then 38.23 grams of finely divided food grade purity added calcium hydroxide (in addition to any residual calcium hydroxide contained in the overbased calcium sulfonate) having a mean particle size of around 1 to 5 microns was mixed with 50 grams of water, and the mixture was added to the grease. Then 23.12 grams boric acid was mixed with 50 ml hot water, and the mixture was added to the grease. The grease was then heated to 390 F. The heating mantle was then removed and the grease was allowed to cool by continuing to stir in open air. When the grease cooled to 170 F, it was removed from the mixer and given three passes through a three-roll mill to achieve a final smooth homogenous texture.

The grease of Example 6 had a worked 60 stroke penetration of 320. The percent overbased oil-soluble calcium sulfonate in the final grease was 27.6%. In this example, all of the hexylene glycol converting agent was added with the water, a portion of the acetic acid was then added prior to any heating, and a portion added after heating to 190° F. for 45 minutes. Neither of the two additions of acetic acid involved a "delay," because there is another non-aqueous converting agent used (hexylene glycol) and the 10 minute mixing interval without heating is not considered a delay. All of the hexylene glycol (which is the primary converting agent) and hydroxystearic acid added pre-conversion were added with the water according to prior art practice. As such, this example did not involve any "delay" and resulted in a higher than desired percentage of overbased calcium sulfonate. Based on this example, a time lapse in the addition of at least a portion of the acetic acid does not aid in reducing the amount of overbased calcium sulfonate to desired levels, when there is no delay for the other non-aqueous converting agent, which is why such addition is not considered a "delay" for purposes of this invention.

Example 6A

Another grease was made almost exactly the same as the previous Example 6 grease. The only difference was that once 190 F was reached during the initial heating, no additional glacial acetic acid was added. The grease had a worked 60 stroke penetration of 339. The percent overbased oil-soluble calcium sulfonate in the final grease was 27.6%. These results are similar to Example 6, and further show that a time interval between the addition of water and addition of acetic acid, when there is another non-aqueous converting agent used, is not a "delay" that results in improved thickener yield.

Example 7

Another calcium complex grease using the same equipment, raw materials, amounts, and manufacturing process as the Example 6 grease was made, except that there was a delay in adding the non-aqueous converting agent (hexylene glycol). The other initial ingredients (including water and acetic acid) were mixed and heated to a temperature of about 190° F. (a first temperature adjustment delay period) and held at that temperature for 1 hour (a first holding delay period) prior to adding the hexylene glycol. When the hexylene glycol was added, the grease was held at 190 F-200 F until conversion appeared to be complete. Then the remaining process was the same as the previous Example 6 grease. The final grease had a worked 60 stroke penetration of 281. The percent overbased oil-soluble calcium sulfonate in the final grease was 27.6%. The dropping point was >650 F. As can be seen, the grease of this example had an improved thickener yield compared to the grease of the previous Example 6 as evidenced by the much firmer penetration despite having essentially the same percentage overbased oil-soluble calcium sulfonate. In fact, using a linear dilution relation of worked penetration to the percentage of overbased calcium sulfonate in the final grease, the predicted percentage of overbased calcium sulfonate in the Example 7 grease would be 24.2% if it was diluted with sufficient base oil to obtain the same worked penetration of the Example 6 grease. This example shows improved results over examples 6 and 6A where the only change was the delayed addition of the non-aqueous converting agent hexylene glycol.

The results and processes used in Examples 1-7 herein are summarized in Table 1 below. The amounts of overbased calcium sulfonate indicated in parenthesis are the amounts of overbased calcium sulfonate estimated when additional base oil is added to dilute the sample grease to achieve the same penetration as in the example number indicated after the dash, and as described above. These first seven examples taken together strongly demonstrate that thickener yield is improved by delaying the addition of the non-aqueous converting agent. Additionally, the thickener yield is improved by the delayed addition with (1) both poor quality and good quality overbased calcium sulfonates and (2) typical prior art calcium containing bases (e.g. calcium hydroxide) for reacting with complexing acids are used and when added calcium carbonate or calcium hydroxyapatite are used for reacting with complexing acids. The complex greases also demonstrated excellent dropping points.

TABLE 1

| Complex Overbased Calcium Sulfonate Greases | | | | | | | | |
|---|---|---|---|---|---|---|---|---|
| | Ex. No. | | | | | | | |
| | 1 | 2 | 3 | 4 | 5 | 6 | 6A | 7 |
| % Overbased Calcium Sulfonate | 23.9 | 21.1 (19.2 - Ex. 1) | 21.4 | 31.0 | 29.2 | 27.6 | 27.6 | 27.6 (24.2 - Ex. 6) |
| Quality of Calcium Sulfonate | Poor | Poor | Poor | Good | Good | Good | Good | Good |
| Added Calcium Base | Calcium hydroxyapatite, calcium carbonate, and calcium hydroxide | Calcium hydroxyapatite, calcium carbonate, and calcium hydroxide | Calcium hydroxyapatite, calcium carbonate, and calcium hydroxide | Cal. Carbonate | Cal. Carbonate | Cal. Hydroxide | Cal. Hydroxide | Cal. Hydroxide |
| Worked 60 Penetration | 287 | 261 | 290 | 271 | 265 | 320 | 339 | 281 |
| Dropping Point, F. | >650 | >650 | >650 | 629 | >650 | Not tested | Not tested | >650 |
| First Temperature adjustment delay period | No | Yes | Yes | No | Yes | No | No | Yes |
| First Temp Range, F. | N/A | 190 | 190 | N/A | 190 | N/A | N/A | 190 |
| First Holding delay period, hr. | N/A | 1 | No, immediate addition after reaching 190 | N/A | 1 | N/A | N/A | 1 |

The following examples further demonstrates the superior properties of overbased calcium sulfonate greases of the present invention that can be achieved with delayed addition of the non-aqueous converting agent and with varying delay period and temperature ranges for the duration of each delay period.

Example 8

Another calcium sulfonate complex grease was made using calcium hydroxyapatite, added calcium carbonate, and added calcium hydroxide as the calcium containing bases for reaction with complexing acids according to an embodiment of the '768 application. This example is a baseline for comparison with Examples 9-17, as there was no delay in the addition of the non-aqueous converting agent (hexylene glycol) in this example.

The grease of Example 8 was made as follows: 264.98 grams of 400 TBN overbased oil-soluble calcium sulfonate were added to an open mixing vessel followed by 378.68 grams of a solvent neutral group 1 paraffinic base oil having a viscosity of about 600 SUS at 100 F, and 11.10 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 23.96 grams of a primarily C12 alkylbenzene sulfonic acid were added. After mixing for 20 minutes, 50.62 grams of calcium hydroxyapatite with a mean particle size of around 1 to 5 microns and 3.68 grams of food grade purity added calcium hydroxide having a mean particle size around 1 to 5 microns were added and allowed to mix in for 30 minutes. Then 0.84 grams of glacial acetic acid and 10.56 grams of 12-hydroxystearic acid were added and allowed to mix in for 10 minutes. Then 55.05 grams of finely divided added calcium carbonate with a mean particle size of around 1 to 5 microns were added and allowed to mix in for 5 minutes. Then 13.34 grams of hexylene glycol and 39.27 grams water were added (no delay). The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 7.34 grams of the same added calcium hydroxide were added and allowed to mix in for 10 minutes. Then 1.59 grams of glacial acetic acid were added followed by 27.22 grams of 12-hydroxystearic acid. After the 12-hydroxystearic acid melted and mixed into the grease, 9.37 grams of boric acid was mixed in 50 grams of hot water and the mixture was added to the grease. Due to the heaviness of the grease, another 62.29 grams of the same paraffinic base oil were added. Then 17.99 grams of a 75% solution of phosphoric acid in water was added and allowed to mix in and react. Another 46.90 grams of paraffinic base oil were added. The mixture was then heated with an electric heating mantle while continuing to stir. When the grease reached 300 F, 22.17 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.30 grams of food grade anhydrous calcium sulfate having a mean particle size of around 1 to 5 microns were added. When the temperature of the grease cooled to 200 F, 2.27 grams of an aryl amine antioxidant and 4.46 grams of a polyisobutylene polymer were added. An additional 55.77 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 281. The percent over-based oil-soluble calcium sulfonate in the final grease was 24.01%. The dropping point was >650 F.

Example 9

Another calcium sulfonate complex grease was made in like manner with the previous Example 8 grease. The only significant difference was that the addition of the hexylene glycol was delayed until the grease had been heated to about 190 F to 200 F (a first temperature adjustment delay period) and held at that temperature for 30 minutes (a first holding delay period). The grease was made as follows: 264.04 grams of 400 TBN overbased oil-soluble calcium sulfonate were added to an open mixing vessel followed by 378.21 grams of a solvent neutral group 1 paraffinic base oil having a viscosity of about 600 SUS at 100 F, and 11.15 grams of PAO having a viscosity of 4 cSt at 100 C. The 400 TBN overbased oil-soluble calcium sulfonate was a poor quality calcium sulfonate similar to the one previously described and used in Examples 10 and 11 of the 768 application. Mixing without heat began using a planetary mixing paddle. Then 23.91 grams of a primarily C12 alkylbenzene sulfonic acid were added. After mixing for 20 minutes, 50.60 grams of calcium hydroxyapatite with a mean particle size around 1 to 5 microns and 3.61 grams of food grade purity added calcium hydroxide having a mean particle size around 1 to 5 microns were added and allowed to mix in for 30 minutes. Then 0.83 grams of glacial acetic acid and 10.56 grams of 12-hydroxystearic acid were added and allowed to mix in for 10 minutes. Then 55.05 grams of finely divided added calcium carbonate with a mean particle size around 1 to 5 microns were added and allowed to mix in for 5 minutes. Then 38.18 grams water was added. The mixture was heated until the temperature reached 190 F (a first temperature adjustment delay period). The temperature was held between 190 F and 200 F for 30 minutes (a first holding delay period). Then 13.31 grams of hexylene glycol was added. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. An additional 16 ml of water was added to replace water that had been lost due to evaporation. Then 7.39 grams of the same added calcium hydroxide were added and allowed to mix in for 10 minutes. Then 1.65 grams of glacial acetic acid were added followed by 27.22 grams of 12-hydroxystearic acid. After the 12-hydroxystearic acid melted and mixed into the grease, an additional 54.58 grams of the same paraffinic base oil was added due to the grease becoming heavier. Then 9.36 grams of boric acid was mixed in 50 grams of hot water and the mixture was added to the grease. Due to the heaviness of the grease, another 59.05 grams of the same paraffinic base oil were added. Then 18.50 grams of a 75% solution of phosphoric acid in water was added and allowed to mix in and react. Another 52.79 grams of paraffinic base oil were added. The mixture was then heated with an electric heating mantle while continuing to stir. When the grease reached 300 F, 22.25 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.15 grams of food grade anhydrous calcium sulfate having a mean particle size of around 1 to 5 microns were added. When the temperature of the grease cooled to 200 F, 2.29 grams of an aryl amine antioxidant and 4.79 grams of a polyisobutylene polymer were added. An additional 108.11 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 272. The percent over-based oil-soluble calcium sulfonate in the final grease was 21.78%. The dropping point was >650 F. As can be seen, this grease had an improved thickener yield compared to the grease of Example 8.

Example 10

Another calcium sulfonate complex grease was made in like manner with the previous Example 8 and 9 greases. The only significant difference was that the addition of the hexylene glycol was delayed until the grease had been heated to about 190 F to 200 F (first temperature adjustment delay period) and held at that temperature for 2 hours (first holding delay period). The grease was made as follows: 264.35 grams of 400 TBN overbased oil-soluble calcium sulfonate were added to an open mixing vessel followed by 377.10 grams of a solvent neutral group 1 paraffinic base oil having a viscosity of about 600 SUS at 100 F, and 11.02 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 24.00 grams of a primarily C12 alkylbenzene sulfonic acid were added. After mixing for 20 minutes, 50.66 grams of calcium hydroxyapatite with a mean particle size of around 1 to 5 microns and 3.76 grams of food grade purity added calcium hydroxide having a mean particle size of around 1 to 5 microns were added and allowed to mix in for 30 minutes. Then 0.91 grams of glacial acetic acid and 10.60 grams of 12-hydroxystearic acid were added and allowed to mix in for 10 minutes. Then 55.05 grams of finely divided added calcium carbonate with a mean particle size of around 1 to 5 microns were added and allowed to mix in for 5 minutes. Then 38.50 grams water was added. The mixture was heated until the temperature reached 190 F (a first temperature adjustment delay period). The temperature was held between 190 F and 200 F for two hours (a first holding delay period). Then 13.57 grams of hexylene glycol was added. Another 15 ml of water was also added since some of the originally added water had evaporated during the two hours of heating. It should be noted that such addition of water in this example to make up for evaporative losses (and in all other examples where it occurs) does not re-initiate the start of a new delay period since, it is simply to replace some of the originally added water. Once visible conversion had begun, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Another 35 ml of water was added. Then 7.27 grams of the same calcium hydroxide were added and allowed to mix in for 15 minutes. Then 1.59 grams of glacial acetic acid were added followed by 27.25 grams of 12-hydroxystearic acid. Then 9.36 grams of boric acid was mixed in 50 grams of hot water and the mixture was added to the grease. Due to the heaviness of the grease, another 55.79 grams of the same paraffinic base oil were added. Then 18.15 grams of a 75% solution of phosphoric acid in water was added and allowed to mix in and react. The mixture was then heated with an electric heating mantle while continuing to stir. When the grease reached 300 F, 22.08 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.08 grams of food grade anhydrous calcium sulfate having a mean particle size of around 1 to 5 microns were added. When the temperature of the grease cooled to 200 F, 2.44 grams of an aryl amine antioxidant and 4.52 grams of a polyisobutylene polymer were added. An additional 216.00 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 285. The percent overbased oil-soluble calcium sulfonate in the final grease was 21.87%. The dropping point was >650 F. As can be seen, this grease had an improved thickener yield compared to the grease of Example 8 and was similar to the grease of Example 9.

Example 11

Another calcium sulfonate complex grease was made in like manner with the previous Examples 8-10 greases. The only significant difference was that the addition of the hexylene glycol was delayed until the grease had been heated to about 190 F to 200 F (a first temperature adjustment delay period) and held at that temperature for 30 minutes (a first holding delay period), then cooled to 160 F (a second temperature adjustment delay period) and held at 160 F to 170 F for two hours (a second holding delay period), then heated back up to 190 F (a third temperature adjustment delay period) with immediate addition of the hexylene glycol upon reaching 190 F (no third holding delay period).

The grease of Example 11 was made as follows: 264.09 grams of 400 TBN overbased oil-soluble calcium sulfonate were added to an open mixing vessel followed by 380.83 grams of a solvent neutral group 1 paraffinic base oil having a viscosity of about 600 SUS at 100 F, and 11.22 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 23.97 grams of a primarily C12 alkylbenzene sulfonic acid were added. After mixing for 20 minutes, 50.59 grams of calcium hydroxyapatite with a mean particle size of around 1 to 5 microns and 3.73 grams of food grade purity added calcium hydroxide having a mean particle size of around 1 to 5 microns were added and allowed to mix in for 30 minutes Then 0.82 grams of glacial acetic acid and 10.57 grams of 12-hydroxystearic acid were added and allowed to mix in for 10 minutes. Then 55.03 grams of finely divided added calcium carbonate with a mean particle size of around 1 to 5 microns were added and allowed to mix in for 5 minutes. Then 38.11 grams water was added. The mixture was heated until the temperature reached 190 F (a first temperature adjustment delay period). The temperature was held between 190 F and 200 F for 30 minutes (a first holding delay period). Then the temperature was reduced to 160 F (a second temperature adjustment delay period), and the temperature was held between 160 F and 170 F for two hours (a second holding delay period). During this time, an additional 15 ml of water was added since some of the originally added water had evaporated. As already mentioned, subsequent pre-conversion additions of water to make up for evaporation losses are not used in determining delay periods, only the first addition of water is used. Then the temperature was increased to 190 F (a third temperature adjustment delay period). Another 20 ml of water was added. Immediately thereafter, 13.20 grams of hexylene glycol was added (no third holding delay period). Once visible conversion had begun, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Due to the amount of thickening that had occurred, another 54.53 grams of the same paraffinic base oil were added and allowed to mix in. Then 7.27 grams of the same calcium hydroxide were added and allowed to mix in for 15 minutes. Then 1.60 grams of glacial acetic acid were added followed by 27.23 grams of 12-hydroxystearic acid. After 5 minutes, 9.38 grams of boric acid was mixed in 50 grams of hot water and the mixture was added to the grease. Due to the heaviness of the grease, another 55.41 grams of the same paraffinic base oil were added. Then 18.10 grams of a 75% solution of phosphoric acid in water was added and allowed to mix in and react. The mixture was then heated with an electric heating mantle while continuing to stir. When the grease reached 300 F, 22.25 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.06 grams of food grade anhydrous calcium sulfate having a mean particle size of around 1 to 5 microns were added. When the temperature of the grease cooled to 200 F, 2.51 grams of an aryl amine antioxidant and 5.43 grams of a polyisobutylene polymer were added. An additional 135.25 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 278. The percent overbased oil-soluble calcium sulfonate in the final grease was 22.27%. The dropping point was >650 F. As can be seen, this grease had an improved thickener yield compared to the grease of Example 8.

Example 12

Another calcium sulfonate complex grease was made in like manner with the previous Examples 8-11 greases. The only significant difference was that the addition of the hexylene glycol was delayed until the grease had been heated to 160 F (a first temperature adjustment delay period) and held at 160 F to 170 F for two hours and 30 minutes (first holding delay period), then heated up to 190 F (a second temperature adjustment delay period) with immediate addition of the hexylene glycol upon reaching 190 F (no second holding delay period).

The grease of Example 12 was made as follows: 264.48 grams of 400 TBN overbased oil-soluble calcium sulfonate were added to an open mixing vessel followed by 382.94 grams of a solvent neutral group 1 paraffinic base oil having a viscosity of about 600 SUS at 100 F, and 11.18 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 24.21 grams of a primarily C12 alkylbenzene sulfonic acid were added. After mixing for 20 minutes, 50.68 grams of calcium hydroxyapatite with a mean particle size of around 1 to 5 microns and 3.64 grams of food grade purity added calcium hydroxide having a mean particle size of around 1 to 5 microns were added and allowed to mix in for 30 minutes. Then 0.89 grams of glacial acetic acid and 10.61 grams of 12-hydroxystearic acid were added and allowed to mix in for 10 minutes. Then 55.06 grams of finely divided added calcium carbonate with a mean particle size of around 1 to 5 microns were added and allowed to mix in for 5 minutes. Then 39.08 grams water was added. The mixture was heated until the temperature reached 160 F. The temperature was held between 160 F and 170 F for two hours and 30 minutes. During this time, an additional 15 ml of water was added since some of the originally added water had evaporated. Then the temperature was increased to 190 F and immediately thereafter, 13.19 grams of hexylene glycol was added. Also, another 25 ml of water was added. Once visible conversion had begun, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 7.36 grams of the same calcium hydroxide were added and allowed to mix in for 10 minutes. Then 1.53 grams of glacial acetic acid were added followed by 27.15 grams of 12-hydroxystearic acid. Due to the heaviness of the grease, another 54.31 grams of the same paraffinic base oil were added and allowed to mix in. Then 9.36 grams of boric acid was mixed in 50 grams of hot water and the mixture was added to the grease. Since the grease became even heavier, another 57.39 grams of the same paraffinic base oil were added. Then 17.61 grams of a 75% solution of phosphoric acid in water was added and allowed to mix in and react. Another 52.07 grams of the same paraffinic base oil was added. The mixture was then heated with an electric heating mantle while continuing to stir. When the grease reached 300 F, 22.14 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.00 grams of food grade anhydrous calcium sulfate having a mean particle size of around 1 to 5 microns were added. When the temperature of the grease cooled to 200 F, 2.42 grams of an aryl amine antioxidant and 5.62 grams of a polyisobutylene polymer were added. An additional 192.05 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 287. The percent overbased oil-soluble calcium sulfonate in the final grease was 20.36%. The dropping point was 639 F. As can be seen, this grease had an improved thickener yield compared to the grease of Example 8.

Example 13

Another calcium sulfonate complex grease was made in like manner with the previous Example 12 grease. The only significant difference was that the addition of the hexylene glycol was delayed until the grease had been heated to 140 F (a first temperature adjustment delay period) and held at 140 F to 150 F for two hours and 30 minutes (first holding delay period), then heated up to 190 F (a second temperature adjustment delay period) for immediate addition of the hexylene glycol for conversion (no second holding delay period), followed by addition of the other components as outlined in Example 12. The final grease had a worked 60 stroke penetration of 283. The percent overbased oil-soluble calcium sulfonate in the final grease was 20.88%. The dropping point was >650 F. As can be seen, this grease had an improved thickener yield compared to the grease of Example 8.

Example 14

Another calcium sulfonate complex grease was made in like manner with the previous Example 12-13 greases. The only significant difference was that the addition of the hexylene glycol was delayed until the grease had been heated to 110 F (a first temperature adjustment delay period) and held at 110 F to 120 F for two hours and 30 minutes (first holding delay period), then heated up to 190 F (a second temperature adjustment delay period) for immediate addition of the hexylene glycol for conversion (no second holding delay period), followed by addition of the other components as outlined in Example 12. The final grease had a worked 60 stroke penetration of 287. The percent overbased oil-soluble calcium sulfonate in the final grease was 21.63%. The dropping point was >650 F. As can be seen, this grease had an improved thickener yield compared to the grease of Example 8.

Example 15

Another calcium sulfonate complex grease was made in like manner with the previous Example 12-14 greases. The only significant difference was that the addition of the hexylene glycol was delayed until the grease had been stirred and held at ambient laboratory temperature (about 25 C) for two hours and 30 minutes (a first holding delay period, without any temperature adjustment delay period), then heated up to 190 F (a second temperature adjustment delay period) for immediate addition of the hexylene glycol for conversion (no second holding delay period), followed by addition of the other components as outlined in Example 12. The final grease had a worked 60 stroke penetration of 279. The percent overbased oil-soluble calcium sulfonate in the final grease was 21.40%. The dropping point was >650 F. As can be seen, this grease had an improved thickener yield compared to the grease of Example 8. Note that this grease showed significant thickener yield improvement within the general range of thickener yields for all the Example 9-14 greases where the delayed hexylene glycol technique was used even though the first delay (holding delay period) involved no heating at all. Additionally, by comparison of these examples, the first temperature range did not significantly impact the percentage of overbased calcium sulfonate in these greases, although having a first temperature range in the mid-range of around 140-170 produced the best thickener yield results.

Example 16

Another calcium sulfonate complex grease was made in like manner with the previous Examples 8-15 greases. The only significant difference was that the addition of the hexylene glycol was delayed until the grease had been mixed at ambient laboratory temperature for 2 hours and 30 minutes (first holding delay period, without any temperature adjustment), followed by heating to 160 F (a second temperature adjustment delay period) and mixing at 160 F to 170 F for two hours and 30 minutes (second holding delay period), followed heating up to 190 F (a third temperature adjustment delay period) and immediate addition of hexylene glycol (no third holding delay period).

The grease of Example 16 was made as follows: 264.28 grams of 400 TBN overbased oil-soluble calcium sulfonate were added to an open mixing vessel followed by 382.25 grams of a solvent neutral group 1 paraffinic base oil having a viscosity of about 600 SUS at 100 F, and 11.10 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 24.08 grams of a primarily C12 alkylbenzene sulfonic acid were added. After mixing for 20 minutes, 50.59 grams of calcium hydroxyapatite with a mean particle size of around 1 to 5 microns and 3.84 grams of food grade purity added calcium hydroxide having a mean particle size of around 1 to 5 microns were added and allowed to mix in for 30 minutes. Then 0.89 grams of glacial acetic acid and 10.56 grams of 12-hydroxystearic acid were added and allowed to mix in for 10 minutes. Then 55.56 grams of finely divided added calcium carbonate with a mean particle size of around 1 to 5 microns were added and allowed to mix in for 5 minutes. Then 38.59 grams water was added. The mixture mixed for two hours and 30 minutes at ambient laboratory temperature (about 25 C). Then the mixture was heated to 160 F and held between 160 F and 170 F for two hours and 30 minutes. During this time, an additional 20 ml of water was added since some of the originally added water had evaporated. Then the temperature was increased to 190 F and immediately thereafter, 13.68 grams of hexylene glycol was added. Once visible conversion had begun, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Due to the grease becoming heavy, another 57.09 grams of the same paraffinic mineral oil was added. Another 15 ml of water was also added. Then 7.17 grams of the same calcium hydroxide were added and allowed to mix in for 10 minutes. Then 1.56 grams of glacial acetic acid were added followed by 27.16 grams of 12-hydroxystearic acid. Then 9.37 grams of boric acid was mixed in 50 grams of hot water and the mixture was added to the grease. Since the grease became even heavier, another 70.35 grams of the same paraffinic base oil were added. Then 18.20 grams of a 75% solution of phosphoric acid in water was added and allowed to mix in and react. Another 33.49 grams of the same paraffinic base oil was added. The mixture was then heated with an electric heating mantle while continuing to stir. When the grease reached 300 F, 22.59 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.19 grams of food grade anhydrous calcium sulfate having a mean particle size of around 1 to 5 microns were added. When the temperature of the grease cooled to 200 F, 2.27 grams of an aryl amine antioxidant and 5.77 grams of a polyisobutylene polymer were added. An additional 167.19 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 274. The percent overbased oil-soluble calcium sulfonate in the final grease was 20.77%. The dropping point was >650 F. As can be seen, this grease had an improved thickener yield compared to the grease of Example 8.

Example 17

Another calcium sulfonate complex grease was made in like manner with the previous Example 12 grease. The only significant difference was that 25% of the total amount of the hexylene glycol was added at the beginning with the water, prior to any heating (no delay). The remaining hexylene glycol was added after the mixture had first been heated to 160 F (a first temperature adjustment delay period) and held between 160 F and 170 F for two hours and 30 minutes (a first holding delay period). Then the mixture was immediately heated to 190 F-200 F for conversion as usual.

The grease of Example 17 was made as follows: 264.39 grams of 400 TBN overbased oil-soluble calcium sulfonate were added to an open mixing vessel followed by 383.09 grams of a solvent neutral group 1 paraffinic base oil having a viscosity of about 600 SUS at 100 F, and 10.56 grams of PAO having a viscosity of 4 cSt at 100 C. The 400 TBN overbased oil-soluble calcium sulfonate was a poor quality calcium sulfonate similar to the one previously described and used in Examples 9 and 10 of the '768 application. Mixing without heat began using a planetary mixing paddle. Then 24.02 grams of a primarily C12 alkylbenzene sulfonic acid were added. After mixing for 20 minutes, 51.55 grams of calcium hydroxyapatite with a mean particle size of around 1 to 5 microns and 3.64 grams of food grade purity added calcium hydroxide having a mean particle size of around 1 to 5 microns were added and allowed to mix in for 30 minutes. Then 0.90 grams of glacial acetic acid and 10.61 grams of 12-hydroxystearic acid were added and allowed to mix in for 10 minutes. Then 55.26 grams of finely divided added calcium carbonate with a mean particle size of around 1 to 5 microns were added and allowed to mix in for 5 minutes. Then 38.46 grams water and 3.62 grams of hexylene glycol (approximately 25% of the total amount of hexylene glycol added) were added. The mixture was heated until the temperature reached 160 F. The temperature was held between 160 F and 170 F for two hours and 30 minutes. During this time, an additional 15 ml of water was added since some of the originally added water had evaporated. Then 10.46 grams of hexylene glycol and 10 ml of water were added, and the temperature was increased to 190 F. Once visible conversion had begun, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 7.55 grams of the same added calcium hydroxide were added and allowed to mix in for 10 minutes. Then 1.54 grams of glacial acetic acid and 27.13 grams of 12-hydroxystearic acid were added to the grease. Due to the heaviness of the grease, another 57.31 grams of the same paraffinic base oil were added and allowed to mix in. Then 9.36 grams of boric acid was mixed in 50 grams of hot water and the mixture was added to the grease. Then 17.78 grams of a 75% solution of phosphoric acid in water was added and allowed to mix in and react. Another 54.03 grams of the same paraffinic base oil was added. The mixture was then heated with an electric heating mantle while continuing to stir. When the grease reached 300 F, 22.48 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.16 grams of food grade anhydrous calcium sulfate having a mean particle size of around 1 to 5 microns were added. When the temperature of the grease cooled to 200 F, 2.41 grams of an aryl amine antioxidant and 4.41 grams of a polyisobutylene polymer were added. An additional 232.52 grams of the same paraffinic base oil were added. Mixing continued until the grease reached a temperature of 170 F. The grease was then removed from the mixer and given three passes through a three-roll mill to achieve a final smooth homogenous texture. The grease had a worked 60 stroke penetration of 296. The percent overbased oil-soluble calcium sulfonate in the final grease was 20.59%. The dropping point was >650 F. As can be seen, this grease had an improved thickener yield compared to the grease of Example 8.

The results and processes used in Examples 8-17 herein are summarized in Table 2 below. All of these examples used calcium hydroxyapatite, added calcium carbonate and added calcium hydroxide as calcium containing bases for reaction with complexing acids and all used a poor quality overbased calcium sulfonate. These examples taken together strongly demonstrate that thickener yield is improved by delaying the addition of the non-aqueous converting agent, even when a poor quality overbased calcium sulfonate is used and even when there is no heating prior to the first holding delay period (an ambient temperature holding delay period). The complex greases also demonstrated excellent dropping points.

TABLE 2

Complex Overbased Calcium Sulfonate Greases

| | Example No. | | | | | | | | | |
|---|---|---|---|---|---|---|---|---|---|---|
| | 8 No Delay | 9 | 10 | 11 | 12 | 13 | 14 | 15 | 16 | 17 |
| % Overbased Calcium Sulfonate | 24.01 | 21.78 | 21.87 | 22.27 | 20.36 | 20.88 | 21.63 | 21.4 | 20.77 | 20.59 |
| Worked 60 Penetration | 281 | 272 | 285 | 278 | 287 | 283 | 287 | 279 | 274 | 296 |
| Dropping Point, F. | >650 | >650 | >650 | >650 | 639 | >650 | >650 | >650 | >650 | >650 |
| First Temp. Adj. Delay Period | No | Yes | Yes | Yes | Yes | Yes | Yes | Yes | Yes | Yes for ~75% of HG |
| First Temp Range, F. | N/A | 190-200 | 190-200 | 190-200 | 160-170 | 140-150 | 110-120 | 77 (Ambient - no heating) | 77 (Ambient - no heating) | 160-170 |
| First Holding Delay Duration, hr. | N/A | 0.5 | 2 | 0.5 | 2.5 | 2.5 | 2.5 | 2.5 | 2.5 | 2.5 |
| Second Temp. Adj. Delay Period | N/A | N/A | N/A | Yes | Yes | Yes | Yes | Yes | Yes | No |
| Second Temp Range, F. | N/A | N/A | N/A | 160-170 | 190 | 190 | 190 | 190 | 160-170 | N/A |
| Second Holding Delay Duration, hr. | N/A | N/A | N/A | 2 | None - Immediate Addition | None - Immediate Addition | None - Immediate Addition | None - Immediate Addition | 2.5 | N/A |
| Third Temp. Adj. Delay Period | N/A | N/A | N/A | Yes | N/A | N/A | N/A | N/A | Yes | N/A |
| Third Temp Range, F. | N/A | N/A | N/A | 190 | N/A | N/A | N/A | N/A | 190 | N/A |

TABLE 2-continued

| Complex Overbased Calcium Sulfonate Greases | | | | | | | | | | |
|---|---|---|---|---|---|---|---|---|---|---|
| | Example No. | | | | | | | | | |
| | 8 No Delay | 9 | 10 | 11 | 12 | 13 | 14 | 15 | 16 | 17 |
| Third Holding Delay Duration, hr. | N/A | N/A | N/A | None - Immediate Addition | N/A | N/A | N/A | N/A | None - Immediate Addition | N/A |

The following two examples further demonstrates the superior properties of overbased calcium sulfonate greases of the present invention that can be achieved with delayed addition of the non-aqueous converting agent and with varying delay period and temperature ranges for the duration of each delay period.

Example 18

Another complex calcium sulfonate grease was made similar to an embodiment of U.S. Pat. No. 4,560,489 (issued to Witco Corporation on Dec. 24, 1985), without delayed addition of the non-aqueous converting agent for use as a baseline comparison example). The grease of Example 18 was made as follows: 440.02 grams of 400 TBN overbased oil-soluble calcium sulfonate were added to an open mixing vessel followed by 390.68 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application document. Then 17.76 grams of a primarily C12 alkylbenzene sulfonic acid were added. After mixing for 20 minutes, 44.41 grams water was added followed by 14.37 grams of hexylene glycol. Then the batch was heated with continued mixing until the temperature reached 190 F. When the temperature reached 190 F, 5.75 grams of glacial acetic acid were added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 15.37 grams of food grade purity added calcium hydroxide having a mean particle size of around 1 to 5 microns were added and allowed to mix in for 10 minutes. Then 28.59 grams 12-hydroxystearic acid were added and allowed to melt and react. Then 25.33 grams boric acid was mixed with 50 ml hot water, and the mixture was added to the grease. The grease was then heated to 330 F. The heating mantle was then removed and the grease was allowed to cool by continuing to stir in open air. When the grease cooled to 170 F, it was removed from the mixer and given three passes through a three-roll mill to achieve a final smooth homogenous texture. The grease had a worked 60 stroke penetration of 291, and had a dropping point of >650 F. The percent overbased oil-soluble calcium sulfonate in the final grease was 46.92%.

Example 19

Another calcium sulfonate complex grease was made in like manner with the previous Example 18 grease. The only significant difference was that the addition of the hexylene glycol was delayed until the grease had been heated to 160 F (a first temperature adjustment delay period) and held at 160 F to 170 F for two hours and 30 minutes (first holding delay period), then heated up to 190 F (a second temperature adjustment delay period) with immediate addition of the hexylene glycol (no second holding delay period). The grease of Example 19 was made as follows: 440.46 grams of 400 TBN overbased oil-soluble calcium sulfonate were added to an open mixing vessel followed by 387.69 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application document. Then 17.64 grams of a primarily C12 alkylbenzene sulfonic acid were added. After mixing for 20 minutes, 44.0 grams water was added. Then the mixture was heated to 160 F and held between 160 F and 170 F for two hours and 30 minutes. During this time, an additional 43 ml of water was added since most of the originally added water had evaporated. The batch was then heated to 190 F, and 14.49 grams of hexylene glycol and 5.73 grams of glacial acetic acid were immediately added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. An additional 20 ml of water was added during this time since some of the earlier added water had evaporated. Another 3.73 grams of the same paraffinic base oil was added followed by 15.37 grams of food grade purity calcium hydroxide having a mean particle size of around 1 to 5 microns. It was allowed to mix in for 10 minutes Then 28.59 grams 12-hydroxystearic acid were added and allowed to melt and react. Then 25.31 grams boric acid was mixed with 50 ml hot water, and the mixture was added to the grease. The grease was then heated to 330 F. The heating mantle was then removed and the grease was allowed to cool by continuing to stir in open air. When the grease cooled to 170 F, it was removed from the mixer and given three passes through a three-roll mill to achieve a final smooth homogenous texture. The grease had a worked 60 stroke penetration of 260. The percent overbased oil-soluble calcium sulfonate in the final grease was 46.90%. The dropping point was >650 F. It is noted that this grease and the previous Example 18 grease had essentially the same percent overbased calcium sulfonate. However, the worked penetration of this grease was 31 points harder. Therefore, the delayed glycol procedure used in this grease resulted in an improved thickener yield. In fact, using a linear dilution relation of worked penetration to the percentage of overbased calcium sulfonate in the final grease, the predicted percentage of overbased calcium sulfonate in the Example 19 grease would be 41.9% if it was diluted with sufficient base oil to obtain the same worked penetration of the Example 18 grease. Additionally, a very high dropping point was maintained in the Example 19 grease. These examples further demonstrate that the delayed addition of the non-aqueous converting agents improves thickener yield and that far better results are obtained when a poor quality overbased calcium sulfonate is used (as in Examples 9-17) than when a good quality overbased calcium sulfonate is used (as in Examples 18-19). The results of these examples are summarized in Table 3 below.

TABLE 3

| Example No. | 18 | 19 |
|---|---|---|
| % Overbased Calcium Sulfonate | 46.92 | 46.9 (41.9) |
| Quality of Calcium Sulfonate | Good | Good |
| Added Calcium Base | Calcium Hydroxide | Calcium Hydroxide |
| Worked 60 Penetration | 291 | 260 |
| Dropping Point, F. | >650 | >650 |
| Delay in Addition of Non-Aqueous Converting Agent | No | Yes |
| First Temp Range, F. | N/A | 160-170 |
| First Holding delay period, hr. | N/A | 2.5 |
| Second Delay Temp Adj. Period | N/A | Yes |
| Second Temp Range, F. | N/A | 190 |
| Second Holding delay period, hr. | N/A | None- immediate addition |

Additional examples showing the results of delayed addition of a non-aqueous converting agent in simple calcium sulfonate greases are found in Examples 20-23. These examples also demonstrate that improved thickener yield is achieved with the use of hexylene glycol or propylene glycol as the non-aqueous converting agent, when the addition is delayed relative to the pre-conversion addition of water. Similar results are expected for other non-aqueous converting agents where the addition is delayed relative to the addition of water.

Example 20

A simple calcium sulfonate grease was made similar to an embodiment within the scope of U.S. Pat. Nos. 3,377,283 and 3,492,231 (issued to Lubrizol Corporation on Apr. 9, 1968 and Jan. 27, 1970, respectively), without any delay for use as a baseline comparison example. The grease of Example 20 was made as follows: 496.49 grams of 400 TBN overbased oil-soluble calcium sulfonate were added to an open mixing vessel followed by 394.45 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application document. Then 20.23 grams of a primarily C12 alkylbenzene sulfonic acid were added. After mixing for 20 minutes, 44.23 grams water was added followed by 16.57 grams of hexylene glycol. Then the batch was heated with continued mixing until the temperature reached 190 F. When the temperature reached 190 F, 6.20 grams of glacial acetic acid were added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 10 ml of water was added. The resulting grease was then heated to 330 F. The heating mantle was then removed and the grease was allowed to cool by continuing to stir in open air. When the temperature reached 200 F, 2.34 grams of an aryl amine antioxidant was added. When the grease cooled to 170 F, it was removed from the mixer and given three passes through a three-roll mill to achieve a final smooth homogenous texture. The grease had a worked 60 stroke penetration of 331. The percent overbased oil-soluble calcium sulfonate in the final grease was 53.03%, and the dropping point was >650 F.

Example 21

Another simple calcium sulfonate grease was made in like manner with the previous Example 20 grease. The only significant difference was that the addition of the hexylene glycol was delayed until the grease had been heated to 160 F (a first temperature adjustment delay period) and held at 160 F to 170 F for two hours and 30 minutes (first holding delay period), then heated up to 190 F (a second temperature adjustment delay period) with immediate addition of the hexylene glycol (no second holding delay period). The grease was made as follows: 495.41 grams of 400 TBN overbased oil-soluble calcium sulfonate were added to an open mixing vessel followed by 391.96 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application document. Then 19.65 grams of a primarily C12 alkylbenzene sulfonic acid were added. After mixing for 20 minutes, 44.42 grams water was added. Then the mixture was heated to 160 F and held between 160 F and 170 F for two hours and 30 minutes. During this time, an additional 50 ml of water was added since most of the originally added water had evaporated. The batch was then heated to 190 F, and 16.53 grams of hexylene glycol followed by 6.34 grams of glacial acetic acid were added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 10 ml of water was added. The resulting grease was then heated to 330 F. The heating mantle was then removed and the grease was allowed to cool by continuing to stir in open air. When the temperature reached 200 F, 2.32 grams of an aryl amine antioxidant was added. When the grease cooled to 170 F, it was removed from the mixer and given three passes through a three-roll mill to achieve a final smooth homogenous texture. The dropping point of the Example 21 grease was >650 F. The grease had a worked 60 stroke penetration of 290. The percent overbased oil-soluble calcium sulfonate in the final grease was 53.14%.

It is noted that the grease of Example 21 and the previous Example 20 grease had essentially the same percent overbased calcium sulfonate. However, the worked penetration of this grease was 41 points harder. Therefore, the delayed glycol procedure used in this grease resulted in an improved thickener yield. In fact, using a linear dilution relation of worked penetration to the percentage of overbased calcium sulfonate in the final grease, the predicted percentage of overbased calcium sulfonate in the Example 21 grease would be 46.6% if it was diluted with sufficient base oil to obtain the same worked penetration of the Example 20 grease. Additionally, a very high dropping point was maintained.

Example 22

Another simple calcium sulfonate grease was made in like manner to the previous Example 20 grease. However, propylene glycol was used as the non-aqueous converting agent instead of hexylene glycol. This was done to demonstrate that the improvement in thickener yield that has been observed in the previous examples is not specific only to one non-aqueous converting agent. Example 22 is a baseline example where no delay was used. The grease was made as follows: 550.60 grams of 400 TBN overbased oil-soluble calcium sulfonate were added to an open mixing vessel followed by 354.69 grams of a solvent neutral group 1 paraffinic base oil having a viscosity of about 600 SUS at 100 F. Mixing without heat began using, a planetary mixing paddle. The 400 TBN overbased oil-soluble calcium sulfonate was a good quality calcium sulfonate similar to the one previously described and used in Examples 4 and 11 of the '768 application document. Then 22.23 grams of a primarily C12 alkylbenzene sulfonic acid were added. After mixing for 20 minutes, 49.59 grams water was added followed by 12.35 grams of propylene glycol. Then the batch was heated with continued mixing until the temperature reached 190 F. A 6.87 gram portion of glacial acetic acid was added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 20 ml of water was added. The resulting grease was then heated to 330 F. The heating mantle was then removed and the grease was allowed to cool by continuing to stir in open air. When the temperature reached 200 F, 2.41 grams of an aryl amine antioxidant was added. When the grease cooled to 170 F, it was removed from the mixer and given three passes through a three-roll mill to achieve a final smooth homogenous texture. The grease had a worked 60 stroke penetration of 258. The percent overbased oil-soluble calcium sulfonate in the final grease was 58.01%. The dropping point was 600 F.

Example 23

Another simple calcium sulfonate grease was made in like manner with the previous Example 22 grease. The only significant difference was that the addition of the propylene glycol was delayed until the grease had been heated to 160 F (a first temperature adjustment delay period) and held at 160 F to 170 F for two hours and 30 minutes (first holding delay period), then heated up to 190 F (a second temperature adjustment delay period). The grease was made as follows: 550.71 grams of 400 TBN overbased oil-soluble calcium sulfonate were added to an open mixing vessel followed by 354.74 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 11 of the '768 application document. Then 22.92 grams of a primarily C12 alkylbenzene sulfonic acid were added. After mixing for 20 minutes, 49.23 grams water was added. Then the mixture was heated to 160 F and held between 160 F and 170 F for two hours and 30 minutes. During this time, an additional 35 ml of water was added since most of the originally added water had evaporated. Then the batch was heated with continued mixing until the temperature reached 190 F. When the batch reached 190 F, 12.27 grams propylene glycol and 6.89 grams of glacial acetic acid were immediately added (no second holding delay period). Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 15 ml of water was added. The resulting grease was then heated to 330 F. The heating mantle was then removed and the grease was allowed to cool by continuing to stir in open air. When the temperature reached 200 F, 2.38 grams of an aryl amine antioxidant was added. When the grease cooled to 170 F, it was removed from the mixer and given three passes through a three-roll mill to achieve a final smooth homogenous texture. The grease had a worked 60 stroke penetration of 239. The percent overbased oil-soluble calcium sulfonate in the final grease was 57.97%. The dropping point was 591 F.

Once again, by comparing this grease to the previous Example 22 grease, one can see the improvement in thickener yield that resulted from the delayed addition of the non-aqueous converting agent. The percent overbased calcium sulfonate in this Example 23 grease was actually slightly less than that of the previous Example 22 grease. Even so, the worked penetration of this Example 23 grease was about 20 points harder. In fact, using a linear dilution relation of worked penetration to the percentage of overbased calcium sulfonate in the final grease, the predicted percentage of overbased calcium sulfonate in the Example 23 grease would be 53.6% if it was diluted with sufficient base oil to obtain the same worked penetration of the Example 22 grease. The dropping points of the Example 22 and 23 greases were lower than other previous greases, indicating that propylene glycol was not as effective a converting agent as hexylene glycol, at least under the conditions that each were used. Nonetheless, the delayed addition of propylene glycol improved the thickener yield compared to the grease where its addition was not delayed. The results of these examples are summarized in Table 4 below.

TABLE 4

Simple Overbased Calcium Sulfonate Greases

| Example No. | 20 | 21 | 22 | 23 |
|---|---|---|---|---|
| % Overbased Calcium Sulfonate | 53.03 | 53.14 (46.6) | 58.01 | 57.97 (53.6) |
| Worked 60 Penetration | 331 | 290 | 258 | 239 |
| Dropping Point, F. | >650 | >650 | 600 | 591 |
| Non-Aqueous Converting Agent | Hexylene Glycol | Hexylene Glycol | Propylene Glycol | Propylene Glycol |

TABLE 4-continued

| Simple Overbased Calcium Sulfonate Greases | | | | |
|---|---|---|---|---|
| Example No. | 20 | 21 | 22 | 23 |
| Delay in Addition of Non-Aqueous Converting Agent | No | Yes | No | Yes |
| First Temp Range, F. | N/A | 160-170 | N/A | 160-170 |
| First Holding Duration, hr. | N/A | 2.5 | N/A | 2.5 |
| Second Delay Temp Range, F. | N/A | 190 | N/A | 190 |
| Second Holding Duration, hr. | N/A | None - immediate addition | N/A | None - immediate addition |

These examples show that the delayed addition of the non-aqueous converting agent consistently improved thickener yield regardless of which previously documented calcium sulfonate-based grease technology is used. Additionally, the thickener yield improvement is observed regardless of whether the overbased calcium sulfonate used was good or poor quality, as defined in the '768 application, although greater improvements are achieved with poor quality calcium sulfonates within the range of example compositions included herein (which is contrary to what would be expected).

Example greases made according to the delayed addition methodology of the invention described above also show different physical properties compared to example greases where addition of all or some of a non-aqueous converting agent was not delayed, even though the ingredients and quantities thereof used in various comparison sets of the examples were the same or substantially similar. Using Fourier Transform Infrared Spectroscopy (FTIR) and Scanning Electron Microscopy (SEM), testing on samples of the example greases demonstrated that greases made with a delay addition according to the invention could be distinguished from those of similar composition made without the delay. There are differences in the adsorption curve profiles and differences in particle sizes and configurations, for example.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base of had been used so as to provide a No. 2 grade product, as will be understood by those of ordinary skill in the art.

As used herein, the term "thickener yield" as it applies to the subject invention shall be the conventional meaning, namely, the concentration of the highly overbased oil-soluble calcium sultanate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 as commonly used in lubricating grease manufacturing. As used herein, reference to the immediate addition of an ingredient after a temperature has been reached means that the ingredient is added as soon after reaching that temperature as is physically possible given the amount to be added and equipment being used, but if preferably within a short time, less than 10 minutes and more preferably less than 5 minutes, after the mixture reaches approximately the temperature indicated. As used herein: (1) quantities of dispersed calcium carbonate or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient; and (3) all other amounts (including total amounts) of ingredients identified by percentages or parts are by weight of the final grease product, even though the particular ingredient (such as water) may not be present in the final grease or may not be present in the final grease in the quantity identified for addition as an ingredient. As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A method for making a calcium sulfonate grease comprising the steps of:

mixing water, overbased calcium sulfonate containing dispersed amorphous calcium carbonate, and optionally base oil to form a first mixture;

adding at least a portion of one or more non-aqueous converting agents to the first mixture after one or more delay periods to form a pre-conversion mixture;

converting the pre-conversion mixture to a converted mixture by heating until conversion of the amorphous calcium carbonate contained in the overbased calcium sulfonate to crystalline calcium carbonate has occurred; and wherein the grease is a complex calcium sulfonate grease comprising 30% or less overbased calcium sulfonate or the grease is a simple calcium sulfonate grease comprising around 30% to 70% overbased calcium sulfonate; and wherein (a) at least one of the delay periods is a holding delay period wherein the first mixture or pre-conversion mixture is maintained at a temperature or within a range of temperatures for a period of time of at least 20 minutes or (b) at least one of the delay periods is a temperature adjustment delay period where the first mixture or pre-conversion mixture is heated to a temperature of at least 110 F or (c) the converting step comprises maintaining the pre-conversion mixture at temperature between about 190 F and 230 F or (d) a combination thereof.

2. The method according to claim 1 further comprising adding at least a portion of one or more of the non-aqueous converting agents to one or more of the following: the first mixture before any delay period, the first mixture during a delay period, or the pre-conversion mixture during one or more delay periods.

3. The method according to claim 2 wherein acetic acid is not added prior to the converting step.

4. The method according to claim 1 wherein the grease is a complex grease and further comprising the steps of:

mixing one or more complexing acids with the first mixture, pre-conversion mixture, converted mixture, or a combination thereof;

mixing at least one calcium containing base with the first mixture, pre-conversion mixture, converted mixture, or a combination thereof, wherein the calcium containing base comprises calcium hydroxyapatite, added calcium carbonate, or a mixture thereof; and wherein the overbased calcium sulfonate comprises around 0% to 8% residual calcium oxide or calcium hydroxide.

5. The method according to claim 1 wherein at least one of the non-aqueous converting agents is a glycol, a glycol ether, or a glycol polyether.

6. The method according to claim 5 wherein the glycol is hexylene glycol.

7. The method according to claim 6 wherein a first portion of the hexylene glycol is added with the first mixture prior to any delay period and a second portion of the hexylene glycol is added to the first mixture or pre-conversion mixture after or during one or more delay periods; and wherein the one or more delay periods between the addition of the first and second portions of hexylene glycol is (1) a holding delay period of at least 20 minutes; or (2) a temperature adjustment delay period where the first mixture or pre-conversion mixture is heated to a temperature of at least 160 F; or (3) both.

8. The method according to claim 1 wherein the mixing and converting are in an open vessel.

9. The method according to claim 1 wherein the converting is in a pressurized vessel.

10. The method according to claim 8 wherein the converting step comprises maintaining the pre-conversion mixture at temperature between about 190 F and 230 F.

11. The method according to claim 2 wherein at least a portion of one of the non-aqueous converting agents is added to the first mixture or the pre-conversion mixture during one of the delay periods by continuous addition at a substantially steady flow rate or by discrete additions in substantially even increments over the duration of the delay period.

12. The method according to claim 11 wherein at least a portion of the same or a different non-aqueous converting agent is batch added to the first mixture or pre-conversion mixture after one of the delay periods.

13. A method for making a calcium sulfonate grease comprising the steps of:

mixing water, overbased calcium sulfonate containing dispersed amorphous calcium carbonate, and optionally base oil to form a first mixture;

adding at least a portion of one or more non-aqueous converting agents to the first mixture after or during one or more delay periods to form a pre-conversion mixture;

converting the pre-conversion mixture to a converted mixture by heating until conversion of the amorphous calcium carbonate contained in the overbased calcium sulfonate to crystalline calcium carbonate has occurred;

wherein the grease is a complex calcium sulfonate grease comprising 45% or less overbased calcium sulfonate or the grease is a simple calcium sulfonate grease comprising around 30% to 70% overbased calcium sulfonate; and wherein at least one of the delay periods is a holding delay period wherein the first mixture or pre-conversion mixture is maintained at a temperature or within a range of temperatures for a period of time of at least 20 minutes.

14. The method according to claim 13 wherein the overbased calcium sulfonate is a poor quality overbased calcium sulfonate.

15. The method according to claim 13 wherein the overbased calcium sulfonate is a good quality overbased calcium sulfonate.

16. The method according to claim 13 wherein the grease is a complex grease and further comprising the steps of:

mixing one or more complexing acids with the first mixture, pre-conversion mixture, converted mixture, or a combination thereof;

mixing at least one calcium containing base with the first mixture, pre-conversion mixture, converted mixture, or a combination thereof, wherein the calcium containing base comprises calcium hydroxyapatite, added calcium carbonate, or a mixture thereof; and wherein the overbased calcium sulfonate comprises around 0% to 8% residual calcium oxide or calcium hydroxide.

17. The method according to claim 16 wherein no additional calcium oxide or calcium hydroxide is added as the calcium containing base for reacting with complexing acids.

18. The method according to claim 16 wherein the calcium containing base comprises calcium hydroxyapatite and one or more of the following: added calcium oxide, added calcium hydroxide, and added calcium carbonate.

19. The method according to claim 13 wherein the temperature or range of temperatures is between ambient temperature and around 190 F.

20. The method according to claim 13 wherein the period of time for the holding delay period is at least 30 minutes.

21. The method according to claim 13 wherein there are at least two delay periods.

22. The method according to claim 21 wherein one of the delay periods is a temperature adjustment delay period where the first mixture or pre-conversion mixture is heated or cooled.

23. The method according to claim 21 wherein at least a portion of one of the non-aqueous converting agents is added during or after a second or any subsequent delay period.

24. The method according to claim 21 wherein no non-aqueous converting agent is added during or immediately after a first of the delay periods.

25. The method according to claim 21 wherein at least a portion of one of the non-aqueous converting agents is batch added after one of the delay periods and at least a portion of the same or a different non-aqueous converting agent is continuously added during the other delay period.

26. The method according to claim 21 wherein at least a portion of one of the non-aqueous converting agents is added after or during one of the delay periods and at least portion of the same or different non-aqueous converting agent is added after or during the other delay period.

27. The method according to claim 21 wherein at least a portion of one of the non-aqueous converting agents is added with the first mixture before any delay period and at least a portion of the same or a different non-aqueous converting agent is added to the first mixture or pre-conversion mixture after or during one or both delay periods.

28. The method according to claim 13 wherein at least one of the non-aqueous converting agents is a glycol, a glycol ether, or a glycol polyether.

29. The method according to claim 28 wherein the glycol is hexylene glycol.

30. The method according to claim 29 wherein a first portion of the hexylene glycol is added with the first mixture prior to any delay period and a second portion of the hexylene glycol is added to the first mixture or pre-conversion mixture after or during one or more delay periods; and wherein the one or more delay periods between addition of the first and second portions of hexylene glycol is (1) a holding delay period of at least 20 minutes; or (2) a temperature adjustment delay period where the first mixture or pre-conversion mixture is heated to a temperature of at least 160 F; or (3) both.

31. The method according to claim 13 wherein there are at least three delay periods.

32. The method according to claim 31 wherein a first delay period is a temperature adjustment delay period where the first mixture is heated or cooled to a first temperature or first range of temperatures, a second delay period is the holding delay period where the first mixture or pre-conversion mixture is held at the first temperature or first range of temperatures for a period of time, and a third delay period is a temperature adjustment period wherein the first mixture or pre-conversion mixture is heated or cooled to a second temperature or second range of temperatures.

33. The method according to claim 31 wherein a first delay period is the holding delay period where the first mixture is held at around ambient temperature for a period of time; a second delay period is a temperature adjustment delay period where the first mixture or pre-conversion mixture is heated or cooled to a first temperature or first range of temperatures, and a third delay period is another holding delay period where the first mixture or pre-conversion mixture is held at the first temperature or first range of temperatures for a period of time.

34. The method according to claim 13 wherein the mixing and converting are in an open vessel.

35. The method according to claim 13 wherein the converting is in a pressurized vessel.

36. The method according to claim 13 wherein the converting step comprises maintaining the pre-conversion mixture at temperature between about 190 F and 230 F.

37. The method according to claim 13 wherein at least one of the delay periods is around one hour or longer.

38. The method according to claim 13 wherein each delay period is at least 20 minutes.

39. The method according to claim 13 wherein each delay period is at least 30 minutes.

40. The method according to claim 13 wherein at least one of the non-aqueous converting agents is methanol, isopropyl alcohol, or another low molecular weight alcohols.

41. The method according to claim 13 wherein methanol, isopropyl alcohol, or another low molecular weight alcohol is not used as a non-aqueous converting agent.

42. A method for making a calcium sulfonate grease comprising the steps of:

mixing water, overbased calcium sulfonate containing dispersed amorphous calcium carbonate, and optionally base oil to form a first mixture;

adding at least a portion of one or more non-aqueous converting agents to the first mixture after or during one or more delay periods to form a pre-conversion mixture;

converting the pre-conversion mixture to a converted mixture by heating until conversion of the amorphous calcium carbonate contained in the overbased calcium sulfonate to crystalline calcium carbonate has occurred;

wherein the grease is a complex calcium sulfonate grease comprising 22% or less overbased calcium sulfonate or the grease is a simple calcium sulfonate grease comprising around 30% to 70% overbased calcium sulfonate; and wherein (a) at least one of the delay periods is a holding delay period wherein the first mixture or pre-conversion mixture is maintained at a temperature or within a range of temperatures for a period of time of at least 20 minutes or (b) at least one of the delay periods is a temperature adjustment delay period where the first mixture or pre-conversion mixture is heated to a temperature of at least 110 F or (c) the converting step comprises maintaining the pre-conversion mixture at temperature between about 190 F and 230 F or (d) a combination thereof.

43. The method according to claim 42 wherein the overbased calcium sulfonate is a poor quality overbased calcium sulfonate.

44. The method according to claim 42 wherein the grease is a complex grease and further comprising the steps of:

mixing one or more complexing acids with the first mixture, pre-conversion mixture, converted mixture, or a combination thereof;

mixing at least one calcium containing base with the first mixture, pre-conversion mixture, converted mixture, or a combination thereof, wherein the calcium containing base comprises calcium hydroxyapatite, added calcium carbonate, or a mixture thereof; and wherein the overbased calcium sulfonate comprises around 0% to 8% residual calcium oxide or calcium hydroxide.

45. The method according to claim 44 wherein the calcium containing base comprises one or more of the following: calcium hydroxyapatite, added calcium carbonate, added calcium hydroxide, or added calcium oxide.

46. The method according to claim 42 wherein at least a portion of one of the non-aqueous converting agents is added with the first mixture before any delay period and at least a portion of the same or a different non-aqueous converting agent is added after or during one or more delay periods.

47. The method according to claim 42 wherein at least one of the non-aqueous converting agents is a glycol.

48. The method according to claim 47 wherein the glycol is hexylene glycol.

49. The method according to claim 48 wherein a first portion of the hexylene glycol is added with the first mixture before any delay period and a second portion of the hexylene glycol is added after or during one or more delay periods; and wherein the one or more delay periods between the addition of the first and second portions of hexylene glycol is (1) a holding delay period of at least 20 minutes; or (2) a temperature adjustment delay period where the first mixture or pre-conversion mixture is heated to a temperature of at least 160 F; or (3) both.

50. The method according to claim 42 wherein at least a portion of one of the non-aqueous converting agents is added after one of the delay periods.

51. The method according to claim 42 wherein at least one of the delay periods is around one hour or longer.

52. The method according to claim 42 wherein each delay period is at least 20 minutes.

53. The method according to claim 42 wherein the overbased calcium sulfonate is a good quality overbased calcium sulfonate.

54. The method of claim 1 wherein there is at least one delay period prior to the addition of any non-aqueous converting agent.

55. The method of claim 42 wherein there is at least one delay period prior to the addition of any non-aqueous converting agent.

56. The method according to claim 1 wherein the overbased calcium sulfonate is a poor quality overbased calcium sulfonate.

57. The method according to claim 1 wherein a first delay period is a temperature adjustment delay period where the first mixture is heated to a first temperature or first range of temperatures and a second delay period is a holding delay period where the first mixture is held at the first temperature or within the first range of temperatures prior to adding at least portion of the one or more non-aqueous converting agents.

58. The method according to claim 57 wherein the first temperature or first range of temperatures is between 140 F and 230 F and the holding delay period is at least 30 minutes.

59. The method according to claim 58 wherein the first temperature or first range of temperatures is between 190 F and 230 F.

60. The method of claim 59 wherein the grease is a complex grease and the amount of overbased calcium sulfonate is 22% or less.

61. The method of claim 58 wherein no non-aqueous converting agents are added prior to the first delay period.

62. The method according to claim 58 wherein the grease is a complex grease comprising 30% or less good quality overbased calcium sulfonate or is a complex grease comprising 22% or less poor quality overbased calcium sulfonate.

63. The method of claim 1 wherein the grease is a simple grease.

64. The method of claim 13 wherein the grease is a simple grease.

65. The method of claim 42 wherein the grease is a simple grease.

66. The method according to claim 2 wherein any acetic acid added prior to the converting step is entirely added prior to any delay period.

67. The method according to claim 1 wherein any holding delay period is where the first mixture or pre-conversion mixture is maintained at a temperature or within a range of temperatures for a period of time of at least 30 minutes or any temperature adjustment delay period is where the first mixture or pre-conversion mixture is heated to a temperature of at least 160 F.

68. The method according to claim 21 wherein one of the delay periods is a temperature adjustment delay period where the first mixture or pre-conversion mixture is heated to a temperature of at least 160 F.

* * * * *